US012161230B2

(12) United States Patent
Erdman

(10) Patent No.: US 12,161,230 B2
(45) Date of Patent: Dec. 10, 2024

(54) SLEEPER FLIP FURNITURE

(71) Applicant: HANDY BUTTON MACHINE CO., Wheeling, IL (US)

(72) Inventor: Thomas C. Erdman, Fort Atkinson, WI (US)

(73) Assignee: HL HOME FURNISHINGS, INC.

( * ) Notice: Subject to any disclaimer, the term of this patent is extended or adjusted under 35 U.S.C. 154(b) by 473 days.

(21) Appl. No.: 17/495,321

(22) Filed: Oct. 6, 2021

(65) Prior Publication Data

US 2022/0104624 A1 Apr. 7, 2022

Related U.S. Application Data

(60) Provisional application No. 63/088,271, filed on Oct. 6, 2020.

(51) Int. Cl.
*A47C 4/02* (2006.01)
*B65D 85/64* (2006.01)

(52) U.S. Cl.
CPC ..... *A47C 4/028* (2013.01); *B65D 85/64* (2013.01); *B65D 2585/648* (2013.01)

(58) Field of Classification Search
CPC .. A47C 4/028; A47C 4/02; A47C 7/30; A47C 17/00; A47C 17/04
See application file for complete search history.

(56) References Cited

U.S. PATENT DOCUMENTS 6,241,317 B1 * 6/2001 Wu ..... A47C 4/02 297/440.1
8,777,319 B2 * 7/2014 Brandtner ..... A47C 4/028 297/440.15
2003/0111882 A1 * 6/2003 Niederman ..... A47C 4/028 297/232
2012/0146382 A1 * 6/2012 Griggs, Jr. ..... A47C 4/028 297/440.1
2013/0134763 A1 * 5/2013 Koch ..... A47C 4/028 297/440.23
2017/0071354 A1 * 3/2017 Mezzera ..... A47C 13/005
2018/0303242 A1 * 10/2018 Nitori ..... A47C 17/86

OTHER PUBLICATIONS

"Amazon.com: Flip Open Foam Sofa for Kids Room Recliner Sectional Sofa Sleeper Bed Reclining Modern Open Kid Friendly Small Sofa," <https://www.amazon.com/Recliner-Sectional-Reclining-Furniture-Easy2find/dp/B079TTZG6K>, printed Sep. 23, 2019, pp. 1-7.
"Flip Sofa Bed", <https://www.cluliving.com.au/products/flipsofabed>; printed Sep. 23, 2019; pp. 1-5.

* cited by examiner

*Primary Examiner* — Fredrick C Conley
(74) *Attorney, Agent, or Firm* — MARSHALL, GERSTEIN & BORUN LLP

(57) ABSTRACT

A method of packaging a convertible couch into a box includes forming a frame assembly. Forming the frame assembly includes coupling a plurality of arms, a first seat portion, a second seat portion, a first back portion, and a second back portion together. A plurality of pillows and at least one back cushion are positioned within the frame assembly. The frame assembly is positioned into the box after assembly and a divider is placed on top of the frame assembly. A first mattress roll is formed and then a second mattress roll is formed. The first mattress roll and the second mattress roll are placed on the divider in the box and the box is closed and sealed.

17 Claims, 32 Drawing Sheets

SLEEPER FLIP FURNITURE

RELATED APPLICATION

This application claims the benefit of and priority to U.S. Provisional Patent Application No. 63/088,271, filed Oct. 6, 2020, the content of which is incorporated by reference herein in its entireties and for all purposes.

FIELD OF THE DISCLOSURE

The present patents relates to articles of furniture, and more particularly, to a collapsible articles of furniture convertible between a couch or a chair and a bed.

BACKGROUND

Furniture may sometimes be manufactured and shipped as separate components and assembled by the customer or end user. However, the dimensions of certain furniture components may be larger than optimal standard shipping sizes. Thus, certain components of furniture typically are shipped in individual boxes that are designated as a "large package" per UPS Large Package (2020) guidelines. By being designated as "large packages," extra fees may be required when shipping certain furniture components.

SUMMARY

In accordance with a first aspect, a method of packaging a convertible couch into a box is disclosed. The method includes forming a frame assembly. Once the frame assembly is formed, the frame assembly is positioned into the box. A first mattress roll is formed and then a second mattress roll is formed. The first and second mattress rolls are placed inside the box on top of the frame assembly.

In accordance with a second aspect, a method of assembling a convertible couch is disclosed. The method includes forming a seat section by coupling a first seat portion to a second seat portion. A back section is formed by coupling a first back portion to a second back portion. The back portion, once assembled, is secured to the seat portion. A plurality of arms is coupled to the seat section. A set of covers are positioned over the back section and the plurality of arms. The method also includes forming a seat cushion. The seat cushion is positioned on the seat section and between the back section and the plurality of arms.

In accordance with a third aspect, a knock down (KD) sleeper-flip couch includes a frame and a pair of seat fasteners. The frame includes a pair of arms, a pair of back sections, and a pair of seat sections. Each seat section includes an outer side and an inner side including a rabbet having a shoulder and a cheek defining a pair of through holes. When the cheeks of the seat sections overlap, a lap joint is formed, the associated through holes of the seat sections align, and the seat fasteners are positioned through the through holes of the seat sections to couple the seat sections together.

In accordance with a fourth aspect, a knock down (KD) sleeper-flip couch kit includes a first container, a second container, and a third container. The first container includes a frame, including: a pair of arm sections; a pair of back sections; and a pair of seat sections. Each seat section including an outer side and an inner side including a rabbet having a shoulder and a cheek. The arm sections are nested within corresponding seat sections. The second container includes a first seat cushion and a second seat cushion and the third container includes a first seat cover and a second seat cover that are coupled together by a living hinge, a pair of pillows, a pair of back cushions, a pair of pillow covers, and a pair of back cushion covers.

In accordance with the foregoing first, second, third, and/or fourth aspects, the methods and apparatus may further include any one or more of the following:

In an implementation, forming the first mattress roll includes forming the first mattress roll from a spring-coil mattress, and forming the second mattress roll includes forming the second mattress roll from a spring-coil mattress.

In another implementation, forming the frame assembly includes coupling a plurality of arms to one another.

In another implementation, forming the frame assembly includes coupling a first seat portion on a first side of the plurality of arms such that a portion of the first seat portion extends past the plurality of arms.

In another implementation, forming the frame assembly includes disposing hardware in the portion of the first seat portion that extends past the plurality of arms.

In another implementation, forming the frame assembly includes coupling a second seat portion on a second side of the plurality of arms such that a portion of the second seat portion extends past the plurality of arms.

In another implementation, forming the frame assembly includes coupling a first back portion to a second back portion and coupling the first and second back portions to the second seat portion.

In another implementation, the method further includes positioning a divider on the frame assembly after the frame assembly is positioned into the box.

In another implementation, forming the first mattress roll includes rolling a coil-spring mattress and securing the rolled coil-spring mattress with a stretch wrap.

In another implementation, the method further includes placing a set of covers on top of the first and second mattress rolls.

In another implementation, forming the first mattress roll further includes placing a set of covers on the coil-spring mattress before rolling the coil-spring mattress.

In another implementation, forming the second mattress roll further includes placing a set of covers on the coil-spring mattress before rolling the coil-spring mattress.

In another implementation, the method further includes placing a plurality of pillows and at least one back cushion in the frame assembly.

In another implementation, securing the back portion to the seat portion includes securing the first back portion to the first seat portion and securing the second back portion to the second seat portion.

In another implementation, coupling the plurality of arms includes coupling a first arm of the plurality of arms to the first seat portion and coupling a second arm of the plurality of arms to the second seat portion.

In another implementation, the method further includes coupling the plurality of arms to the back section.

In another implementation, coupling the plurality of arms to the back section includes coupling the first arm of the plurality of arms to the first back portion and coupling the second arm of the plurality of arms to the second back portion.

In another implementation, forming the seat cushion includes placing a first portion of the seat cushion in a first pocket of a seat cover and a second portion of the seat cushion in a second pocket of the seat cover, the first pocket being coupling to the second pocket.

In another implementation, positioning the set of covers includes positioning a frame cover of the set of covers over the back section.

In another implementation, positioning the set of covers includes positioning a first arm cover over the first arm of the plurality of arms, and positioning a second arm cover over the second arm of the plurality of arms.

In another implementation, each of the seat sections include a back side, each of the arm sections include a lower side and a back side, and each of the back sections include an inner side, an outer side, and a lower side, further comprising fasteners to: 1) couple the lower side of the arm sections to the corresponding outer sides of the seat sections; 2) couple the back sides of the arm sections to the corresponding outer sides of the back sections; 3) couple the inner sides of the back sections together; and 4) couple the lower sides of the back sections to the corresponding back side of the seat sections.

In another implementation, the seat sections include zigzag springs.

In another implementation, the seat fasteners are thumb screws.

In another implementation, the thumb screws are central legs of the knock down (KD) sleeper-flip couch.

In another implementation, the knock down (KD) sleeper-flip couch includes a first seat cushion, a second seat cushion, a first seat cover, and a second seat cover. The first seat cover is coupled to the second seat cover by a living hinge. The first seat cushion is positionable within the first seat cover and the second seat cushion is positionable within the second seat cover. The first seat cushion and the second seat cushion being stacked and in a first configuration to form a couch. The first seat cushion being rotated about the living hinge to position the first seat cushion and the second seat cushion in a second configuration to form a bed.

In another implementation, the bed is a king size bed.

In another implementation, the first seat cushion is a different thickness than the second seat cushion.

In another implementation, in the first configuration, the second seat cushion is positioned on the seat sections and the first seat cushion is positioned on top of the second seat section.

In another implementation, the first seat cushion has a greater thickness than the second seat cushion.

In another implementation, the knock down (KD) sleeper-flip couch includes arm covers and back section covers, the arm covers being positioned over the arm sections and the back section covers being positioned over the back sections.

In another implementation, the knock down (KD) sleeper-flip couch includes pair of pillows and a pair of back cushions.

In another implementation, the knock down (KD) sleeper-flip couch includes a pair of pillow covers to cover the corresponding pillows and a pair of back cushion covers to cover the corresponding back cushions.

In another implementation, the first seat cushion and the second seat cushion comprise foam.

In another implementation, wherein each of the first container, the second container, and the third container are less than 130 inches length and girth.

In another implementation, each of the first container, the second container, and the third container are approximately 125 inches length and girth.

BRIEF DESCRIPTION OF THE DRAWINGS

FIG. 16 is a flow chart depicting a method of assembling the convertible couch of FIG. 13.

DETAILED DESCRIPTION

The present disclosure is directed to a convertible couch that is positionable between a first configuration, where the convertible couch is a couch, and a second configuration, where the convertible couch is a bed. The convertible couch may be quickly and efficiently assembled. The convertible couch is also designed and manufactured in a manner that allows the entire convertible couch to be placed in a single box for shipping. In doing so, costs for shipping the convertible couch are lower and less of a hassle for end users to pick up and assemble.

Figure 1:
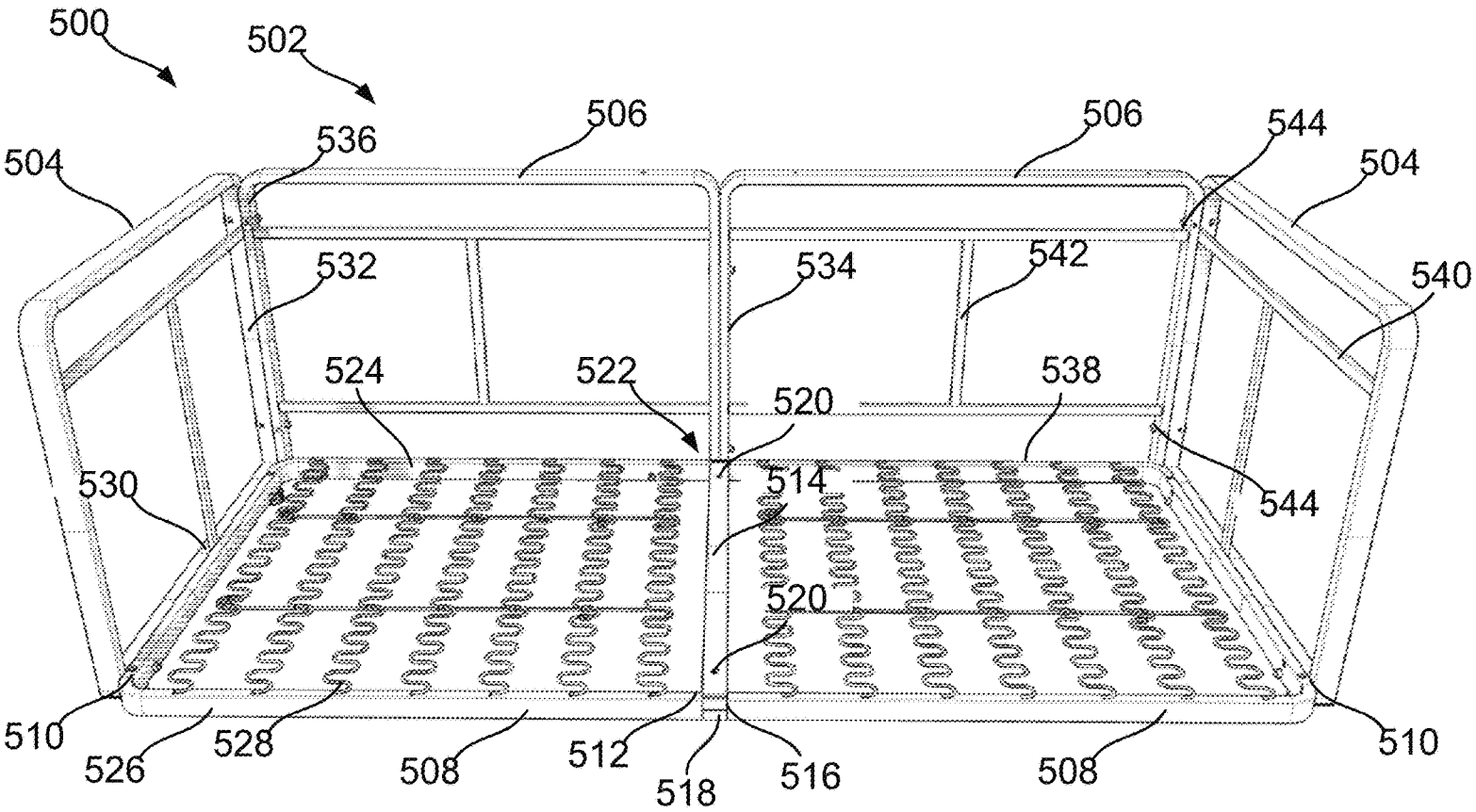
FIG. 1 illustrates an isometric view of a frame of an a knock down (KD) sleeper-flip couch in accordance with the teachings of this disclosure.

FIG. 1 illustrates an isometric view of a frame 500 of an a knock down (KD) sleeper-flip couch 502 in accordance with the teachings of this disclosure. The frame 500 includes a pair of arms section 504, a pair of back sections 506, and a pair of seat sections 508. Each of the seat sections 508 has an outer side 510 and an inner side 512 including a rabbet 514 having a shoulder 516 and a cheek 518 defining a pair of through holes 520 (the shoulder 516, the cheek 518, and the through holes 520 are more clearly shown in FIGS. 2 and 3). The through holes 520 may be threaded. As shown, a lap joint 522 is formed when the cheeks 518 of the seat sections 508 overlap and the associated through holes 520 of the seat sections 508 are aligned. The lap joint 522 is a horizontal lap joint. The lap joint 522 may provide three surfaces (e.g., planar surfaces) that interlock to provide greater resistance to torque and/or a stronger connection as compared to if the lap joint 522 were not provided.

Referring still to the frame 500 of FIG. 1, each of the seat sections 508 include a back side 524 and a front side 526 and has zig-zag springs 528 that extend between the back side 524 and the front side 526. The zig-zag springs 528 however may be differently arranged. Each of the arm sections 504 include a lower side 530 and a back side 532 and each of the back sections 506 include an inner side 534, an outer side 536, and a lower side 538. The arm sections 504 include a T-shaped internal structure 540 and the back sections 506 have an I-shaped internal structure 542. However, the arm sections 504 and/or the back sections 506 may include different internal structures. Fasteners 544 such as bolts are used in the implementation shown to 1) couple the lower side 530 of the arm sections 504 to the corresponding outer sides 536 of the seat sections 508; 2) couple the back sides 524 of the arm sections 504 to the corresponding outer sides 536 of the back sections 506; 3) couple the inner sides 534 of the back sections 506 together; and 4) couple the lower sides 338 of the back sections 506 to the corresponding back side 524 of the seat sections 508.

Figure 2:
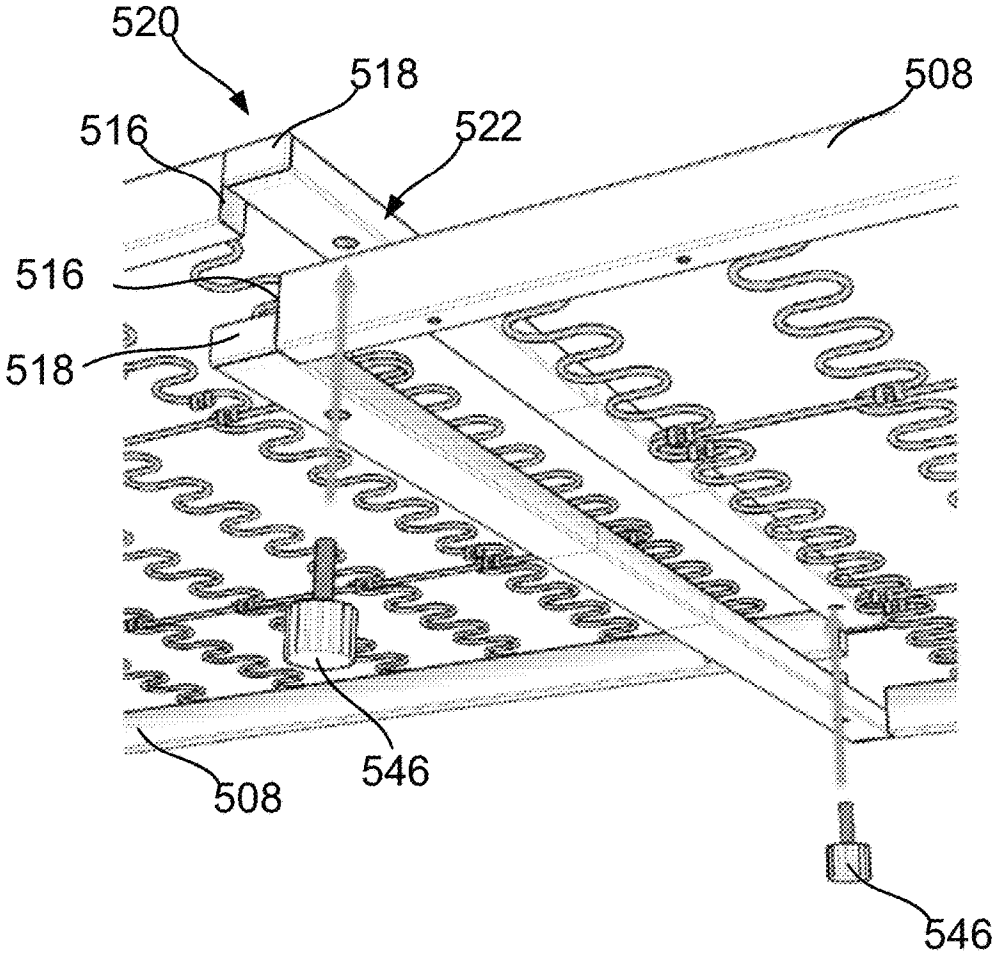
FIG. 2 is an expanded detailed view of the lap joint and a pair of seat fasteners that are positioned through the through holes of the seat sections to couple the seat sections together.

FIG. 2 is an expanded detailed view of the lap joint 522 and a pair of seat fasteners 546 that are positioned through the through holes 520 of the seat sections 508 to couple the seat sections 508 together. The coupling provided by the seat fasteners 546 also strengthens the coupling provided by the lap joint 522 and/or between the seat sections 508. The seat fasteners 546 in this implementation are thumb screws and are used as central legs of the couch 502.

Figure 3:
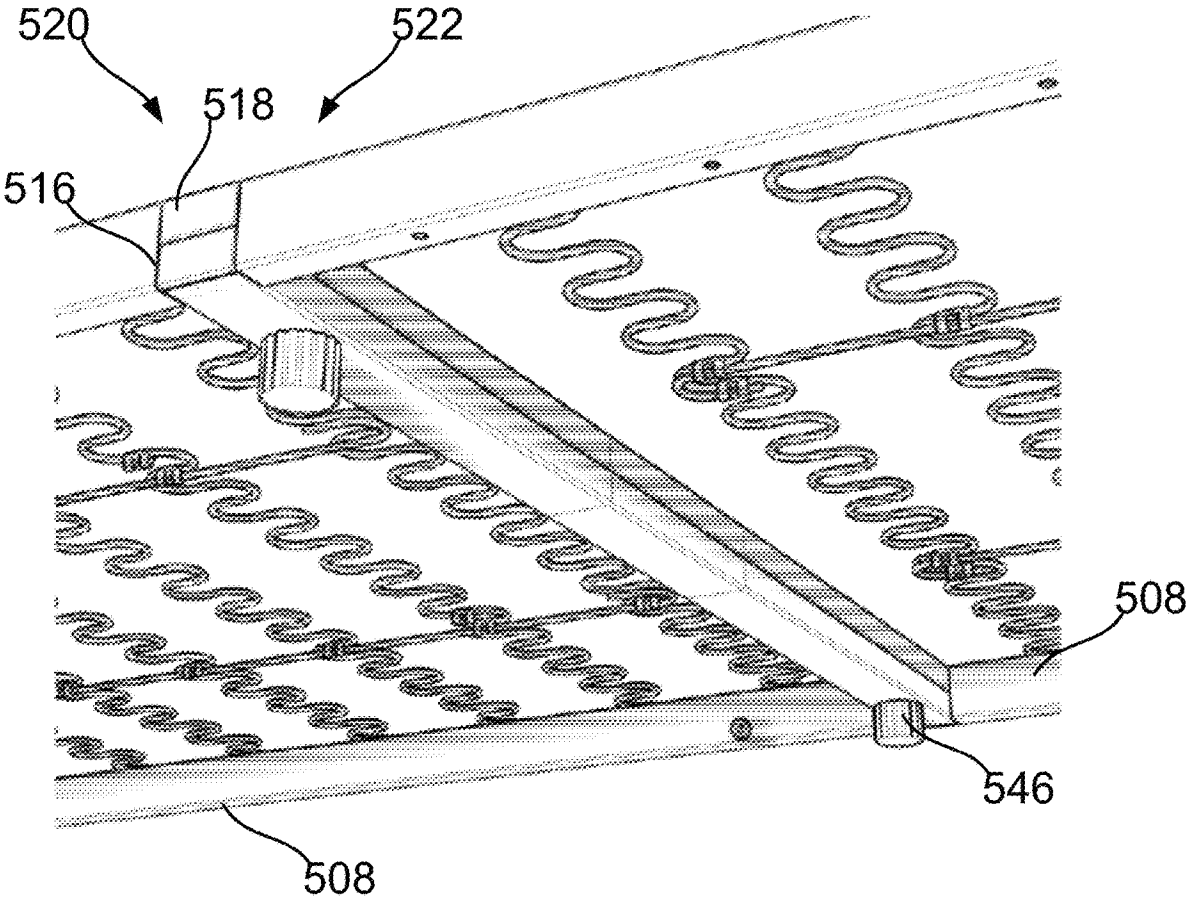
FIG. 3 is a detailed view of the lap joint showing the seat fasteners positioned within the through holes and coupling the seat sections together.

FIG. 3 is a detailed view of the lap joint 522 showing the seat fasteners 546 positioned within the through holes 520 and coupling the seat sections 508 together.

Figure 4:
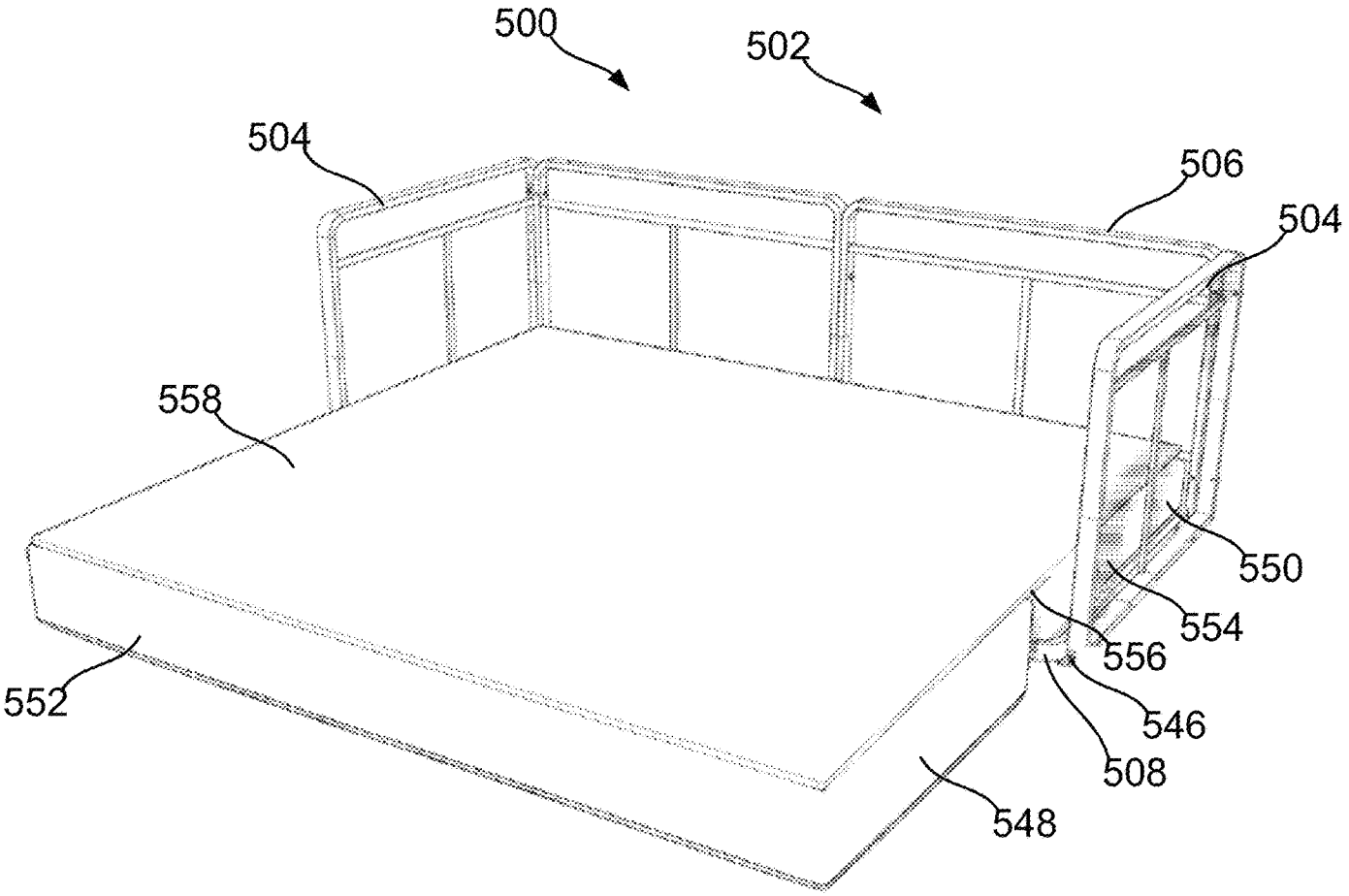
FIG. 4 is an isometric view of the couch showing the frame, a first seat cushion and a second seat cushion and a first seat cover and a second seat cover.

FIG. 4 is an isometric view of the couch 502 showing the frame 500, a first seat cushion 548 and a second seat cushion 550, a first seat cover 552 and a second seat cover 554. The first seat cover 552 is coupled to the second seat cover 554 by a living hinge 556 that can be made of, for example, fabric. The first seat cushion 548 is positioned within the first seat cover 552 and the second seat cushion 550 is positioned within the second seat cover 554.

The first seat cushion 548 is rotatable about the hinge 556 and the second seat cushion 550 from a first configuration (see, FIG. 5) where the first seat cushion 548 and the second seat cushion 550 are stacked and form a couch to a second configuration (see, FIG. 4) where the first seat cushion 548 is placed next to the second seat cushion 550 to form a bed. The second seat cushion 550 is thus positioned on the seat sections 508 and the first seat cushion 548 is positioned on top of the second seat section 550 when the couch 502 is in the first configuration and the first and second seat cushions 548 and 550 are in a non-stacked arrangement in the second configuration.

The first seat cushion 548 is a different thickness than the second seat cushion 550 in the implementation shown and, specifically, the first seat cushion 548 has a greater thickness than the second seat section 550 to accommodate a height of a leg portion of the seat fastener 546 and a height of the seat section 508. The thicknesses of the first and second cushions 548 and 550 allow the first and second cushions 548 and 550 to form a relatively flat surface 558 and, as shown, a king size bed. The cushions 548, 550 however may be differently sized to form any size mattress such as a queen size mattress, a full mattress, and/or a twin extra-long mattress when in the second configuration. The cushions 548, 550 may be foam mattresses and/or pocket-coil mattresses.

Figure 5:
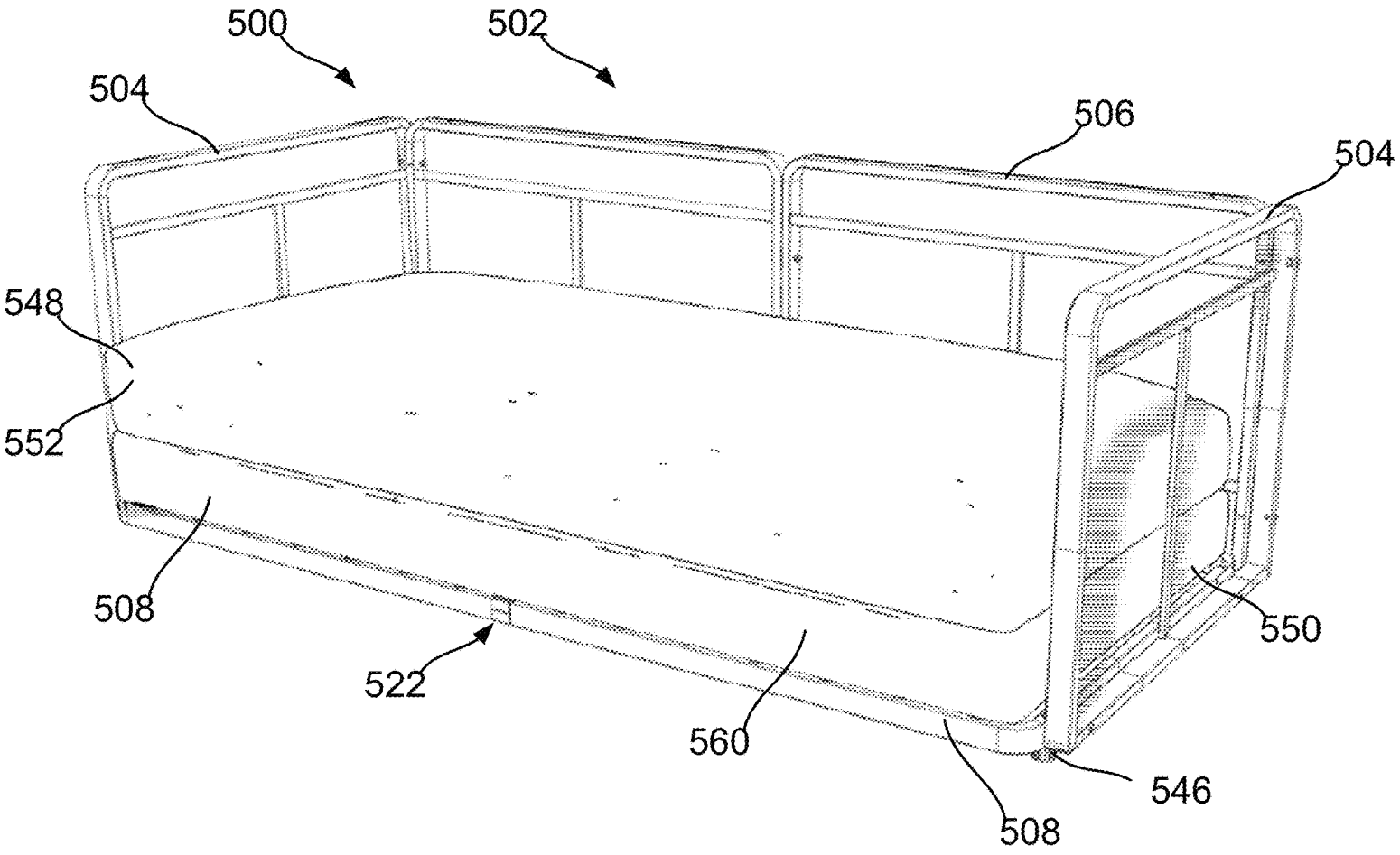
FIG. 5 shows the couch is in the first configuration with the first seat cushion stacked on top of the second seat cushion.

FIG. 5 shows the couch 502 is in the first configuration with the first seat cushion 548 stacked on top of the second seat cushion 550. The second seat section 550 has a front surface 560 that provides a smoother contour and/or an appearance of a front apron of a couch.

Figure 6:
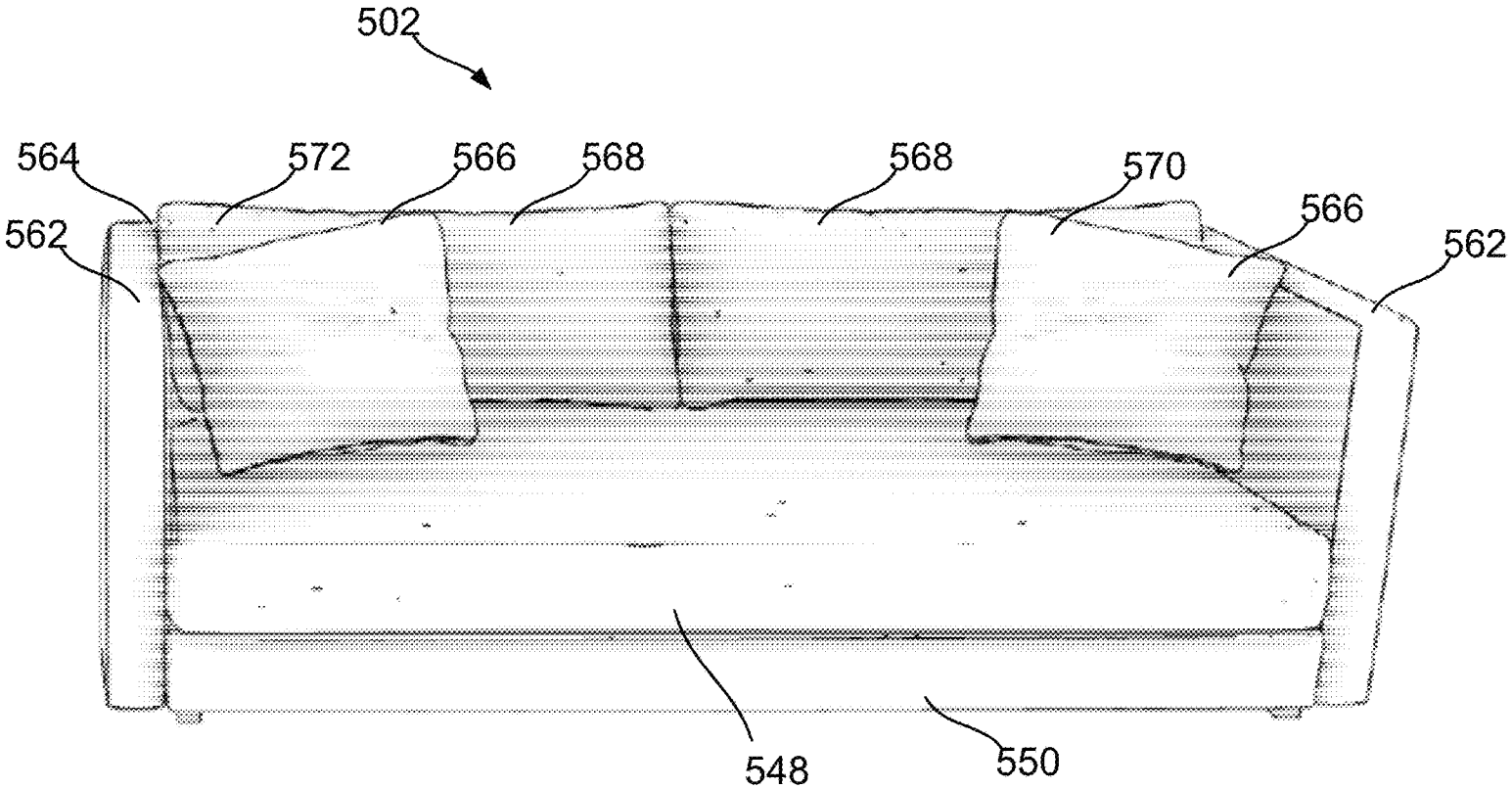
FIG. 6 shows a front view of the couch is in the first configuration and including arm covers positioned over the arm sections and back section covers positioned over the back sections.

FIG. 6 shows a front view of the couch 502 is in the first configuration and including arm covers 562 positioned over the arm sections 504 and back section covers 564 positioned over the back sections 506. A pair of pillows 566 and a pair of back cushions 568 are also shown positioned on the couch 502, where pillow covers 570 cover the corresponding pillows 566 and back cushion covers 572 cover the corresponding back cushions 568.

Figure 7:
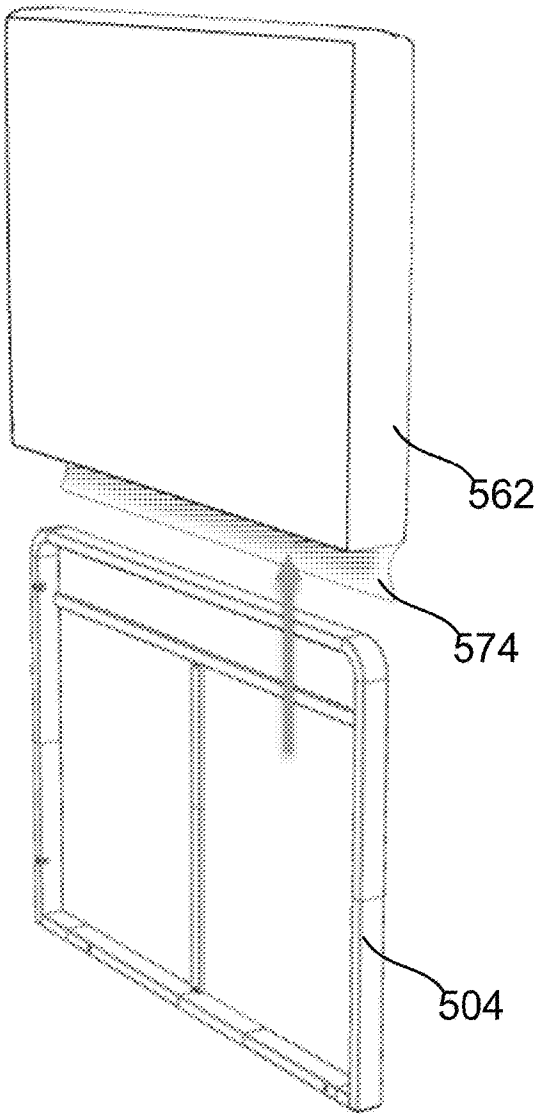
FIG. 7 shows the arm section being positioned within the arm cover having a flap that can be closed to enclose the arm section within the arm cover.

FIG. 7 shows the arm section 504 being positioned within the arm cover 562 having a flap 574 that can be closed to enclose the arm section 504 within the arm cover 562.

Figure 8:
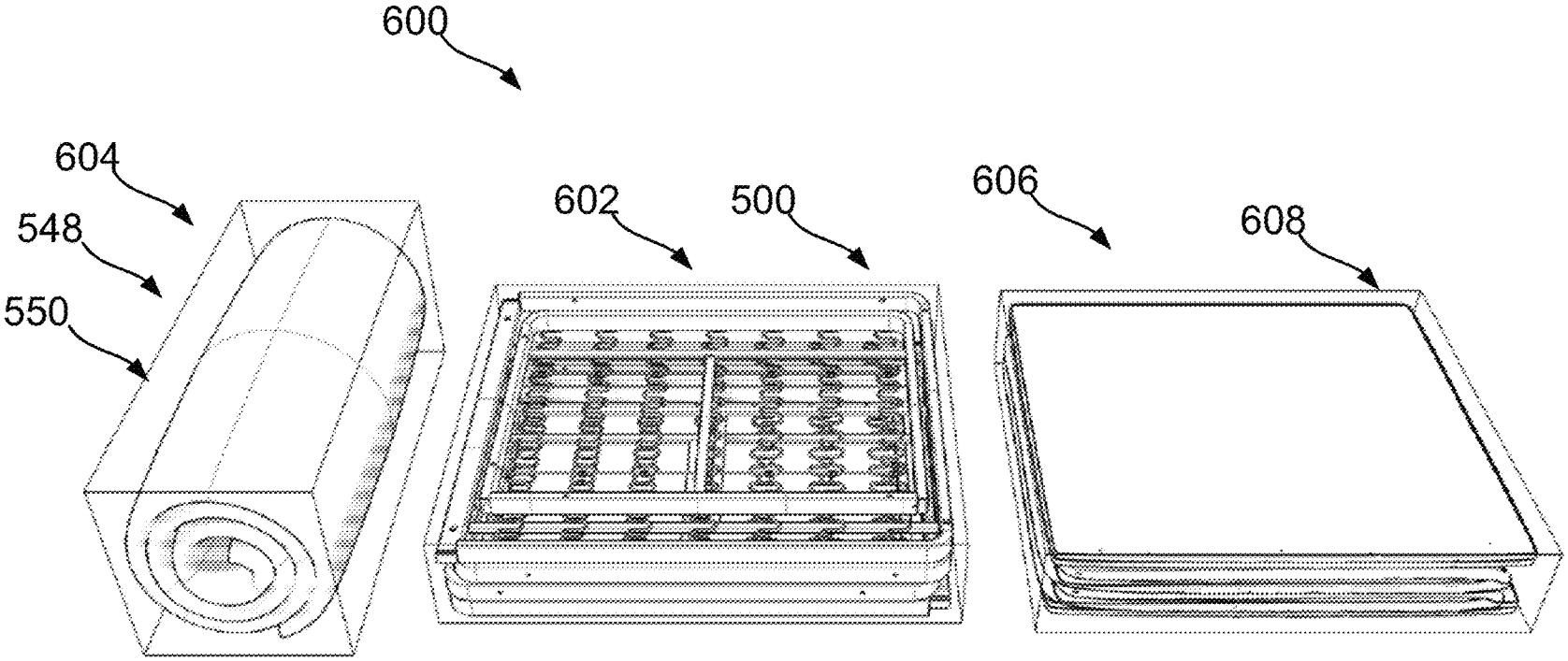
FIG. 8 illustrates a knock down (KD) sleeper-flip couch kit in accordance with the teachings of this disclosure.

FIG. 8 illustrates a knock down (KD) sleeper-flip couch kit 600 in accordance with the teachings of this disclosure. The kit 600 has a first container 602 including the frame 500 and a second container 604 including the first seat cushion 548 and the second seat cushion 550. The frame 500 includes the arm sections 504, the back sections 506, and the seat sections 508. The arm sections 504 are nested within corresponding seat sections 508 in the implementation shown.

The kit 600 also includes a third container 606 including fabric 608 such as the first seat cover 552 and the second seat cover 554 that are coupled together by the living hinge 556, the pillows 566, the back cushions 568, the pillow covers 570, and the back cushion covers 572. Each of the first container 602, the second container 604, and the third container 606 may be less than 130 inches length and girth and/or approximately 125 inches length and girth. Other sizing for one or more of the containers 602, 604, and/or 606 is suitable.

Figure 9:
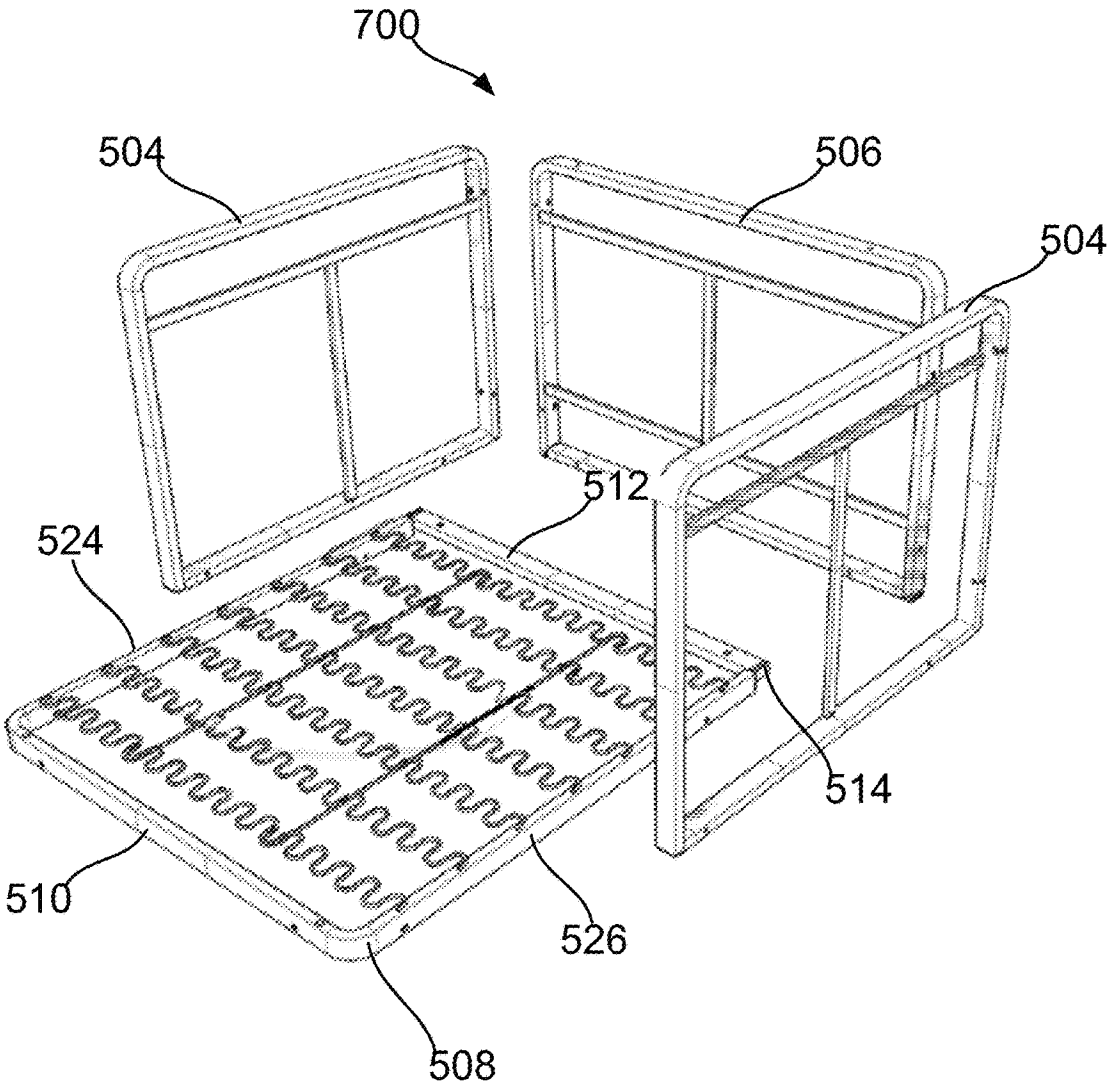
FIG. 9 is an expanded isometric view of a knock down (KD) sleeper-flip chair in accordance with the teachings of this disclosure.

FIG. 9 is an expanded isometric view of a knock down (KD) sleeper-flip chair 700 in accordance with the teachings of this disclosure. The chair 700 uses portions of the frame 500 of the couch 502 and, as such, components of the chair 700 and components of the couch 502 are interchangeable. The chair 700 includes two of the arm sections 504, one of the back sections 506, and one of the seat sections 508. The seat section 508 is oriented such that the back section 506 is coupled to the inner side 512 of the seat section 508 and the arm sections 504 are coupled to the sides 524, 526 of the seat section 508.

Figure 10:
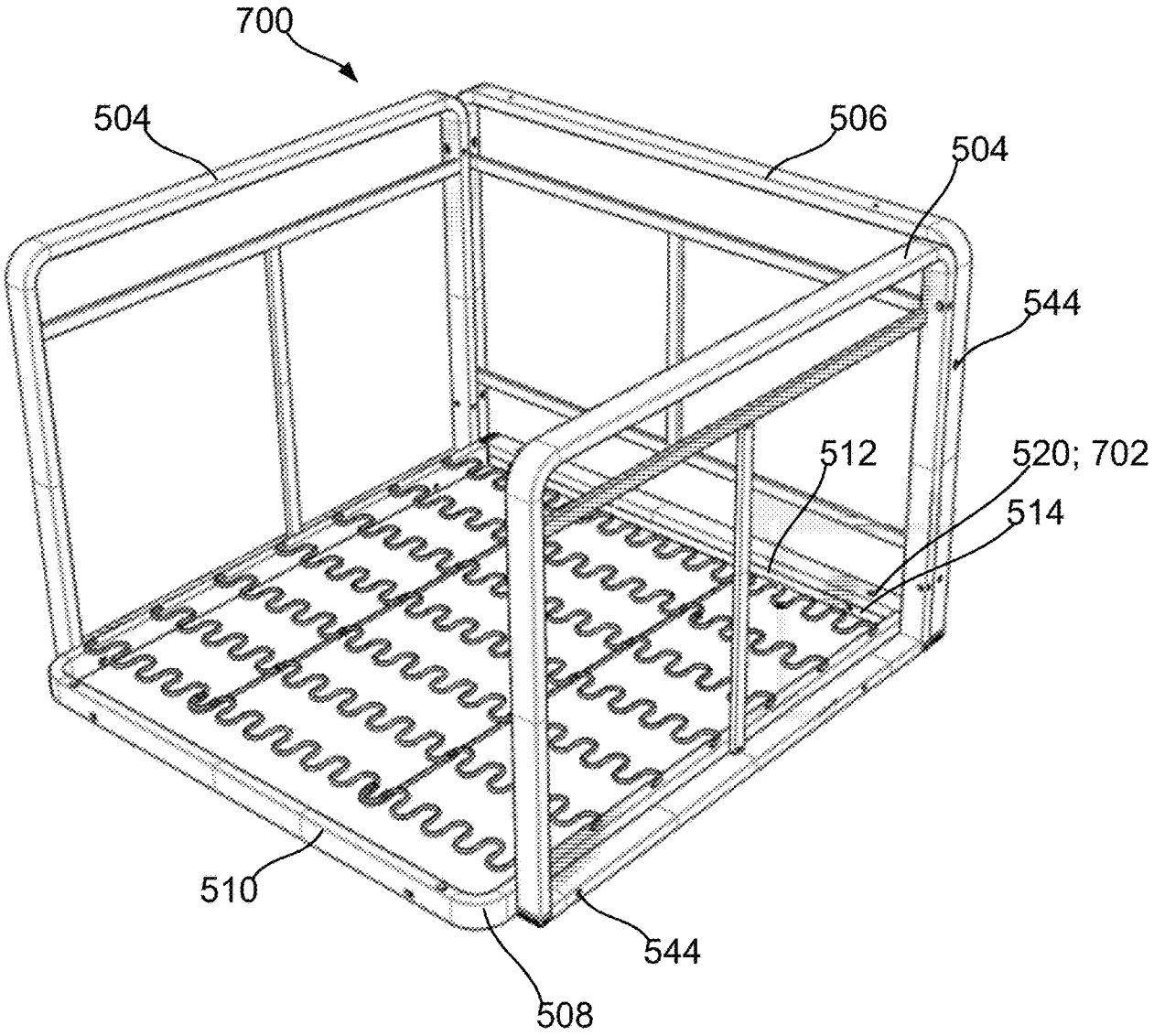
FIG. 10 an isometric view of the chair with the back section coupled to the inner side of the seat section and the arm sections coupled to the sides of the seat section using fasteners.

FIG. 10 an isometric view of the chair 700 with the back section 506 coupled to the inner side 512 of the seat section 508 and the arm sections 504 are coupled to the sides 524, 526 of the seat section 508 using fasteners 544. The back section 506 includes through holes 702 that are aligned with corresponding through holes 520 of the lap joint 522 and receive the seat fasteners 546, thereby strengthening the coupling between the back section 506 and the seat section 508.

Figure 11:
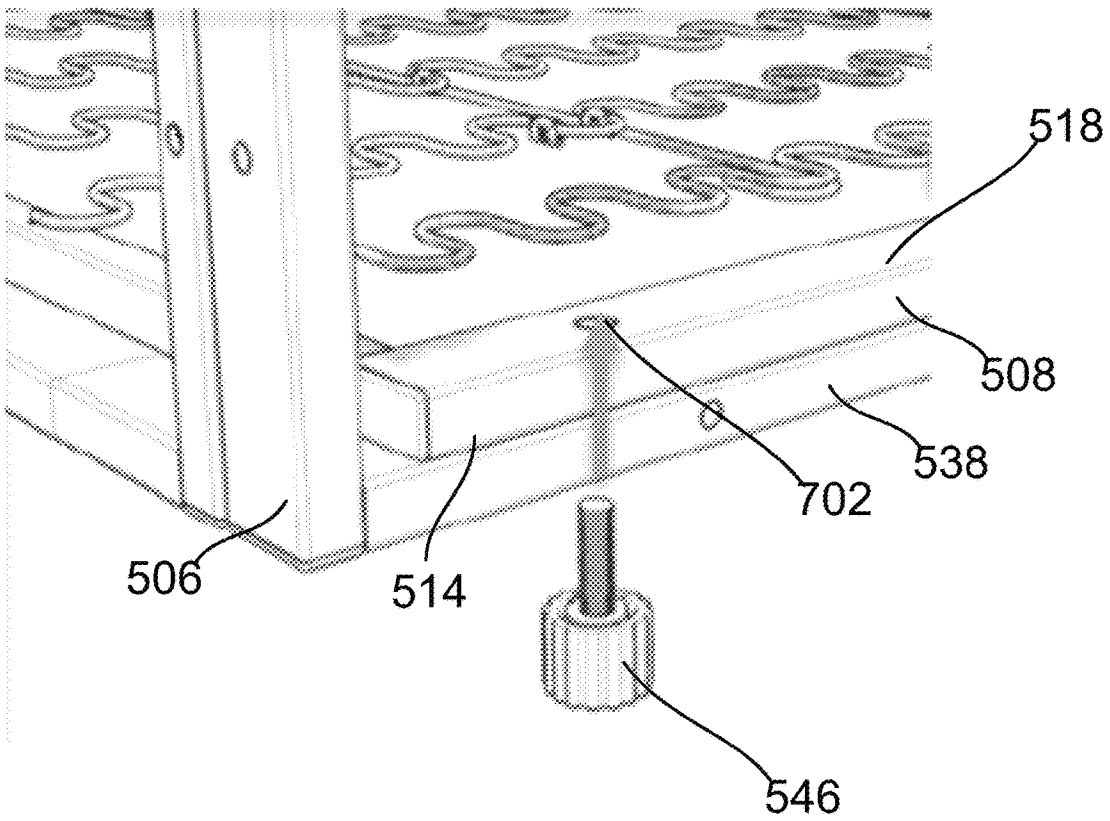
FIG. 11 a detailed isometric view of the coupling between the seat section and the back section.

FIG. 11 a detailed isometric view of the coupling between the seat section 508 and the back section 506. The cheek 518 of the rabbet 514 is positioned on top of the lower side 538 of the back section 506 and the through holes 520, 702 are aligned to receive a corresponding seat fastener 546.

Figure 12:
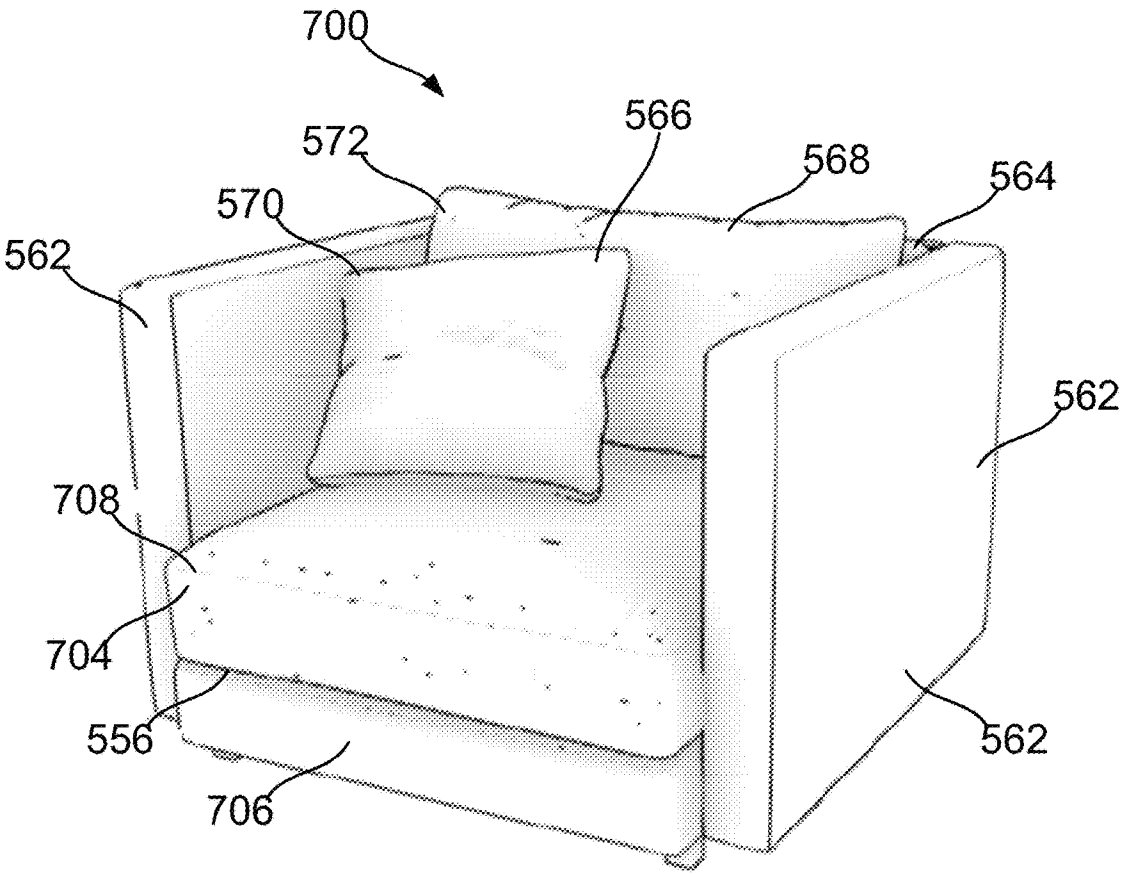
FIG. 12 is an isometric view of the chair including the arm covers positioned over the arm sections and the back section cover positioned over the back section.

FIG. 12 is an isometric view of the chair 700 including the arm covers 562 positioned over the arm sections 504 and the back section cover 564 positioned over the back section 506. One of the pillows 566 and one of the back cushions 568 is shown positioned on the chair 700, where the pillow cover 570 covers the pillow 566 and the back cushion cover 572 covers the back cushion 568. The chair 700 of FIG. 12 also includes a first seat cushion 704 and a second seat cushion 706 and a first seat cover 708 and a second seat cover 710 that are attached by the living hinge 556. The first seat cushion 704 is positioned within the first seat cover 708 and the second seat cushion 706 is positioned within the second seat cover 710.

Similar to the couch 502 disclosed above, the first seat cushion 704 is rotatable about the hinge 556 and the second seat cushion 706 from a first configuration where the first seat cushion 704 and the second seat cushion 706 are stacked and form a seat to a second configuration where the first seat cushion 548 is placed next to the second seat cushion 706 to form a bed. The cushions 704, 706 may be sized to form any size mattress such as a twin mattress and/or a twin extra-long mattresses when in the second configuration.

Figure 13:
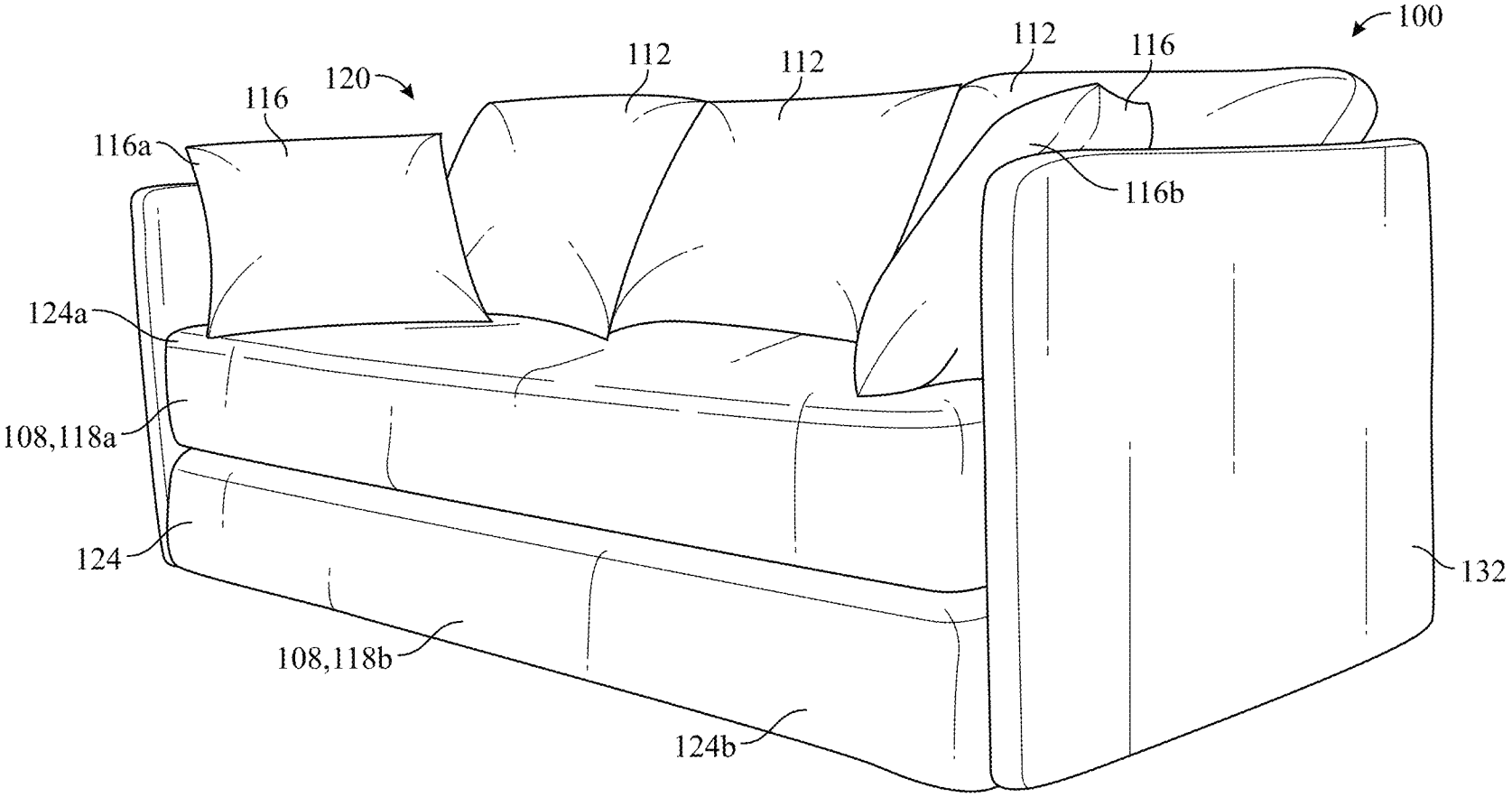
FIG. 13 is a perspective view of a convertible couch in a first configuration, constructed in accordance with the present disclosure.
Figure 14:
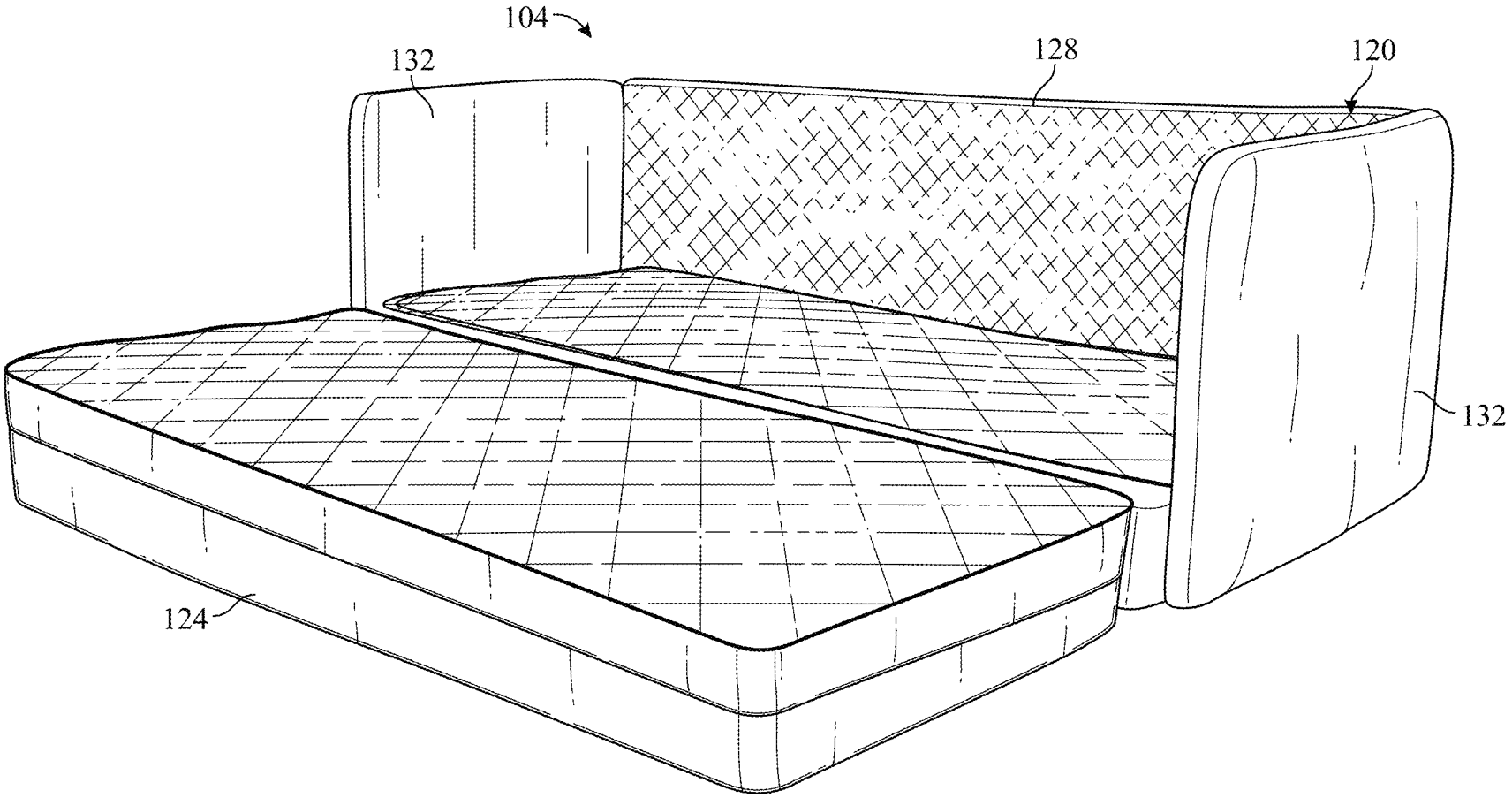
FIG. 14 is a perspective view of the convertible couch of FIG. 13 in a second configuration.

FIGS. 13 and 14 illustrate an example of a convertible couch 100. In particular, FIG. 13 illustrates the convertible couch 100 in a first configuration (e.g., a couch) and FIG. 14 illustrates the convertible couch 100 in a second configuration (e.g., a bed). The convertible couch 100 includes a frame 104 (FIG. 15), a seat cushion 108, at least one back cushion 112, a plurality of pillows 116, and a set of covers 120. The seat cushion 108 includes a first portion 108*a* and a second portion 108*b*. The first portion 108*a* is a pocket-coil mattress. However, in other examples, the first portion 108*a* can be any kind of mattress. In the first configuration (FIG. 13) and the second configuration (FIG. 14) the first portion 108*a* of the seat cushion 108 is disposed within the frame. The second portion 108*b* is also a pocket-coil mattress. However, in other examples, the second portion 108*a* can be any kind of mattress. The seat cushion 108 is disposed in a seat cover 124, which is part of the set of covers 120. In particular, the first portion 108*a* of the seat cushion 108 is disposed in a first pocket 124*a* of the seat cover 124 and the second portion 108*b* of the seat cushion 108 is disposed in a second pocket 124*b* of the seat cover 124. The first pocket 124*a* of the seat cover 124 is coupled to the second pocket 124*b* of the seat cover 124. In particular, the first pocket 124*a* is coupled to the second pocket 124*b* such that the coupling forms a hinge. The hinge allows the first portion 108*a* of the seat cushion 108, when disposed in the seat cover 124, to pivot along an edge of the second portion 108*b* of the seat cushion 108. So configured, the hinge allows the convertible couch 100 to transition from the first configuration (FIG. 13) to the second configuration (FIG. 14). A frame cover 128, which is part of the set of covers 120, is positioned over a portion of the frame 104 and a plurality of arm covers 132, which is part of the set of covers 120, is positioned over another portion of the frame 104.

The convertible couch 100 includes the at least one back cushion 112 and the plurality of pillows 116. As illustrated in FIG. 13, the at least one back cushion 112 is disposed on the seat cushion 108 and extends along a portion of the frame 104. The at least one back cushion 108 includes three cushions, but in other examples the at least one back cushion 108 can include more or less than three cushions. Each back cushion in the at least one back cushion 108 is disposed within a back-cushion cover 136, which is part of the set of covers 120. The plurality of pillows 116 are also disposed on the seat cover 108 within the frame 104. The plurality of pillows 116 includes a first pillow 116*a* and a second pillow 116*b*. However, in other examples, the plurality of pillows 116 can include more or less pillows. Each pillow in the plurality of pillows 116 is disposed within a pillow cover 140, which is part of the set of covers 120.

Figure 15:
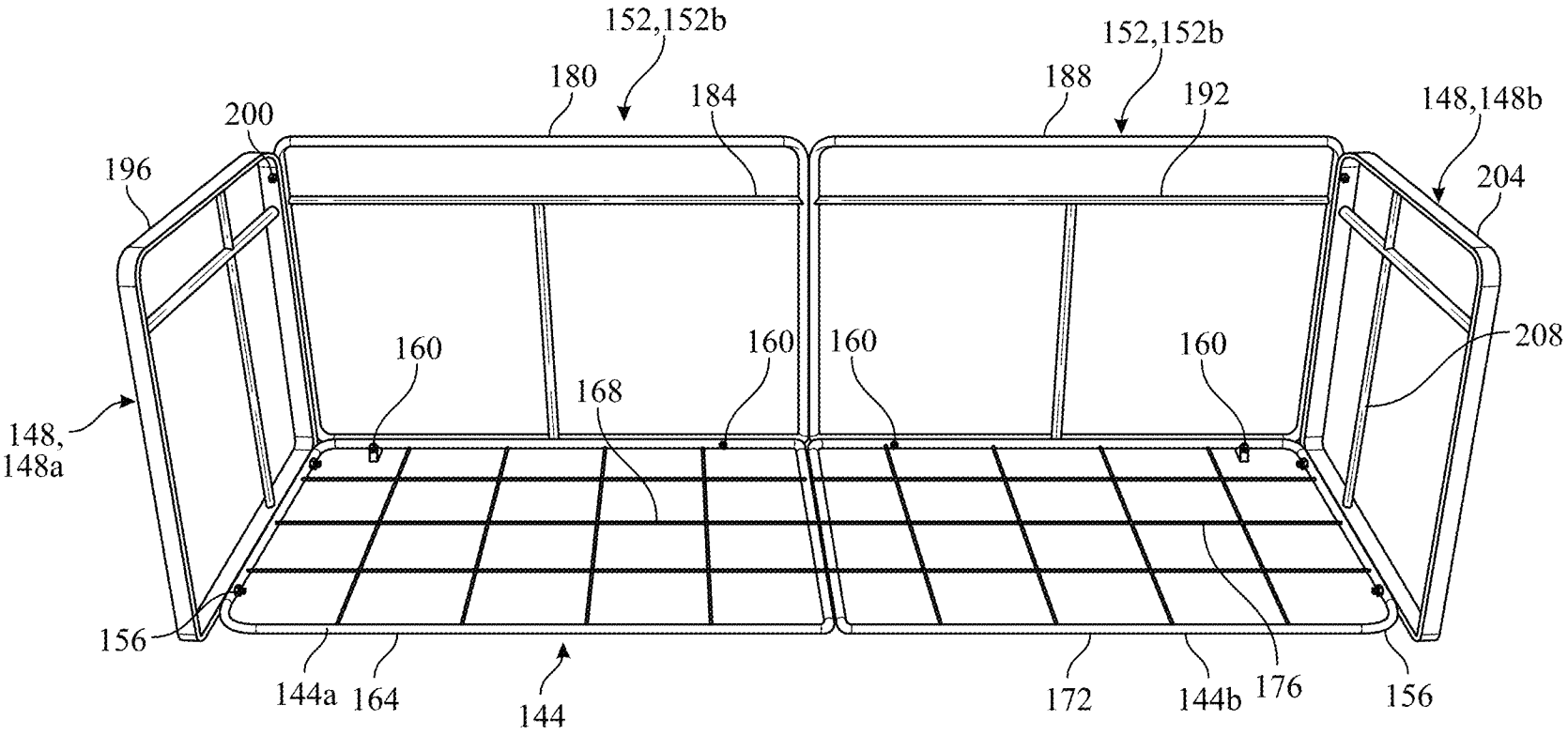
FIG. 15 is a perspective view of a frame of the convertible couch of FIG. 13.

FIG. 15 illustrates the frame 104 of the convertible couch 100 of FIG. 13 with the set of covers 120 removed for clarity. The frame 104 includes a seat section 144, a plurality of arms 148, a back section 152, and a plurality of legs 156. The seat section 144 makes up the base of the convertible couch 100 and is where the seat cushion 108 is placed. The seat section 144 has a first seat portion 144*a* coupled to a second seat 144*b* portion via fasteners 160. The first seat portion 144*a* includes an outer frame 164 and a grid 168 disposed within the outer frame 164. The outer frame 165 of the first seat portion 144*a* has a generally rectangular shape, but may be any shape in other examples. The grid 168 extending within the outer frame 164 of the first seat portion 144*a* provides support to the first seat portion 144*a* thereby distributing the weight of the seat cushion 108 over a greater area. The second seat portion 144*b* similarly includes an outer frame 172 and a grid 176 disposed within the outer frame 172. The outer frame 172 of the second seat portion 144*b* has a generally rectangular shape, but can be any shape in other examples. The grid 176 extending within the outer frame 172 of the second seat portion 144*b* provides support to the second seat portion 144*b* thereby distributing the weight of the seat cushion 108 over a greater area. The first seat portion 144*a* and the second seat portion 144*b* are substantially similar in shape. However, in other examples, the shape of the first seat portion 144*a* can be different from the shape of the second seat portion 144*b*.

The back section 152 of the frame 104 couples to the seat portion 144 and provides support for an individual to rest on when sitting on the seat cushion 108 of the convertible couch 100. The back section 152 includes a first back portion 152*a* coupled to a second back portion 152*b* via fasteners 160. The first back portion 152*a* includes an outer frame 180 and a plurality of support structures 184 are disposed within the outer frame 180. The outer frame 180 of the first back portion 152*a* has a generally rectangular shape, but may take any shape in other examples. The plurality of support structures 184 extending within the outer frame 180 of the first back portion 152*a* provide added support to the first back portion 152*a*. The second back portion 152*b* includes an outer frame 188 and a plurality of support structures 192 disposed within the outer frame 188. The outer frame 188 of the second back portion 152*b* has a generally rectangular shape, but may take any shape in other examples. The plurality of support structures 192 extending within the outer frame 188 of the second back portion 152*b* provides added support to the second back portion 152*b*. The shape of the first back portion 152*a* and the shape of the second back portion 152*b* are substantially similar in shape. However, in other examples, the shape of the first back portion 152*a* can be different from the shape of the second back portion 152*b*.

The plurality of arms 148 is coupled to the seat section 144 and the back section 152. So configured, the plurality of arms 148, the seat section 144, and the back section 152 form the frame 104 of the convertible couch 100 when coupled to one another. The plurality of arms 148 includes a first arm 148*a* and a second arm 148*b*. The first arm 148*a* includes an outer frame 196 and a plurality of support structures 200 disposed within the outer frame 196. The outer frame 196 of the first arm 148*a* has a generally rectangular shape, but may be any shape in other examples. The plurality of support structures 200 extending within the outer frame 196 of the first arm 148*a* provides added support to the first arm 148*a*. The second arm 148*b* includes and outer frame 204 and a plurality of support structures 208 disposed within the outer frame 204. The outer frame 204 of the second arm 148*b* has a generally rectangular shape, but may be any other shape in other examples. The plurality of support structures 208 extending within the outer frame 204 of the second arm 148*b* provides added support to the second arm 148*b*. The shape of the first arm 148*a* and the shape of the second arm 148*b* are substantially similar in shape. However, in other examples, the shape of the first arm 148*a* can be different from the shape of the second arm 148*b*.

FIGS. 16-28 generally depict an example method of assembling the convertible couch 100 of FIG. 13. In particular, FIG. 16 depicts a flow chart of an example method of assembling the convertible couch 100, and FIGS. 17-28 depict the steps illustrated schematically in FIG. 16. Accordingly, FIG. 16 and FIGS. 17-28 may be read in tandem to illustrate the method of assembling the convertible couch 100 of FIG. 13.

Figure 17:
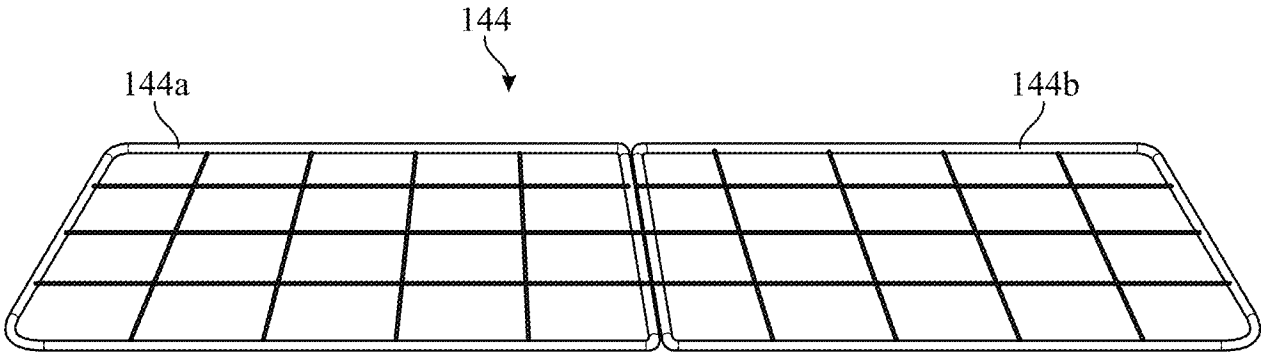
FIG. 17 is a perspective view of a portion of the frame of the convertible couch of FIG. 15.
Figure 18:
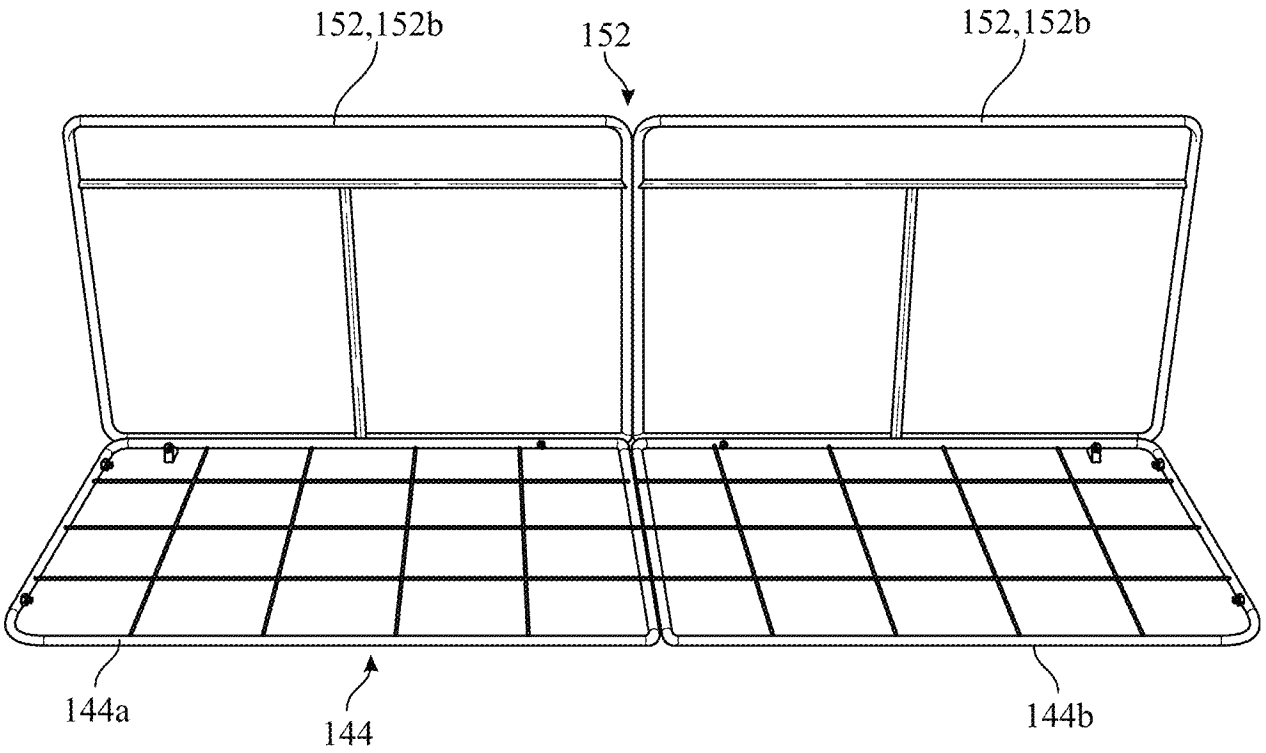
FIG. 18 is a perspective view of a portion of the frame of the convertible couch of FIG. 15.

The method of assembling the convertible couch 100 includes forming the seat section 144 by coupling the first seat portion 144*a* to the second seat portion 144*b* (step 304), as illustrated in FIG. 17. The first seat portion 144*a* may be coupled to the second seat portion 144*b* using the fasteners 160. The method 400 then includes forming the back section 152 by coupling the first back portion 152*a* to the second back portion 152*b* (step 308), as illustrated in FIG. 18. The first back portion 152*a* may be coupled to the second back portion 152*b* using the fasteners 160. Once the back section 152 is formed, the back section 152 is secured to the seat section 144 (step 312), as illustrated in FIG. 18. The back section 152 is coupled to the seat section 144 using the fasteners 160. In other examples, however, the back section 152 can be coupled to the seat section 144 using a tongue and groove, a snap fit, etc.

Figure 19:
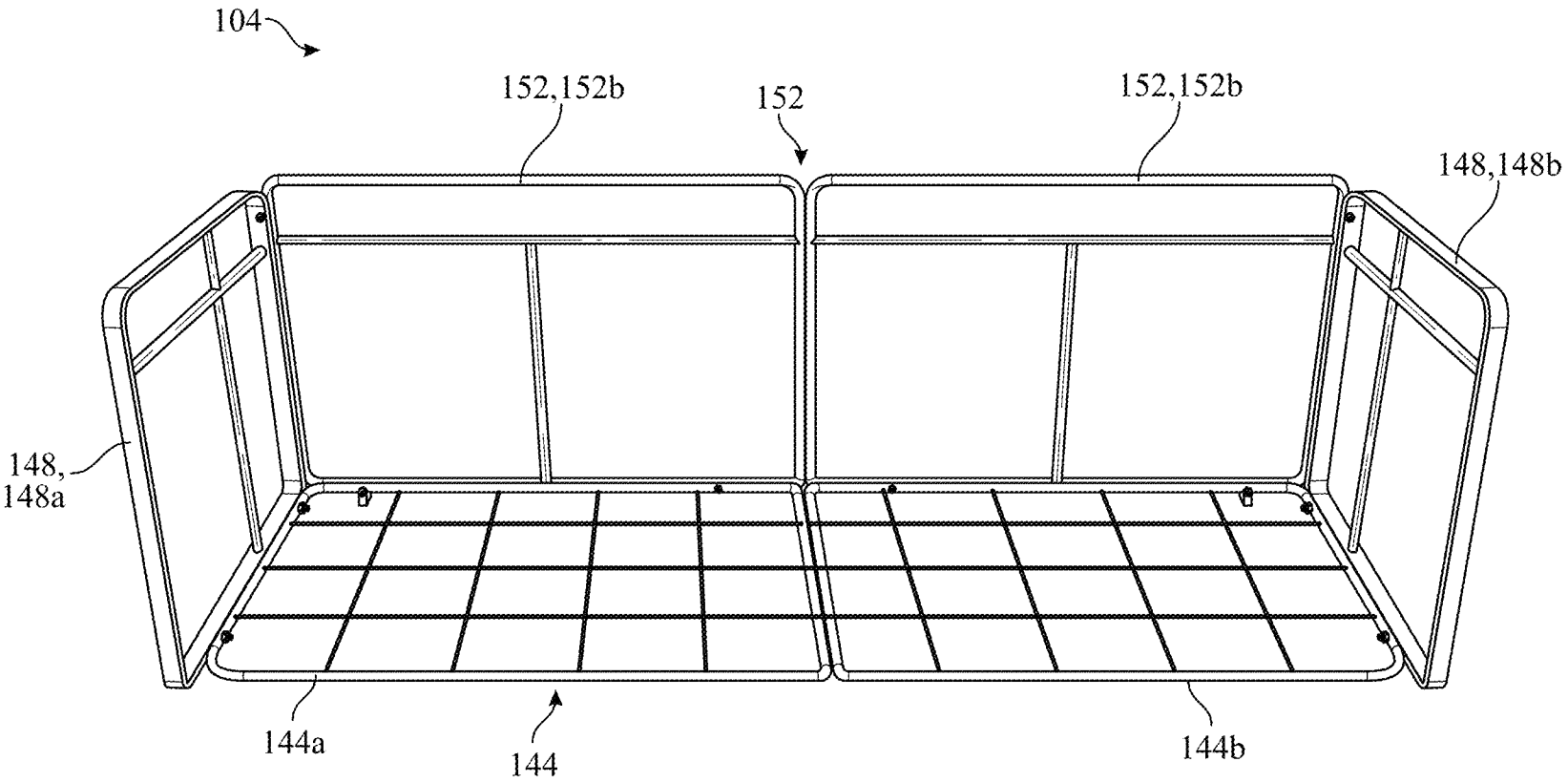
FIG. 19 is a perspective view of a portion of the frame of the convertible couch of FIG. 15.

The plurality of arms 148 is coupled to the seat section 144 (step 316), as illustrated in FIG. 19. In particular, the first arm 148*a* of the plurality of arms 148 is coupled to the first seat portion 144*a* of the seat section 144 and the second arm 148*b* of the plurality of arms 148 is coupled to the second seat portion 144*b* of the seat section 144 using fasteners. The plurality of arms 148 may also be coupled to the back section 152 in addition to, or instead of, the seat section 144. In particular, the first arm 148*a* of the plurality of arms 148 may be coupled to the first back portion 152*a* of the back section 152, and the second arm 148*b* of the plurality of arms 148 may be coupled to the second back portion 152*b* of the back section 152. So configured, coupling the seat section 144, the back section 152, and the plurality of arms 148 to one another forms the frame 104.

Figure 20:
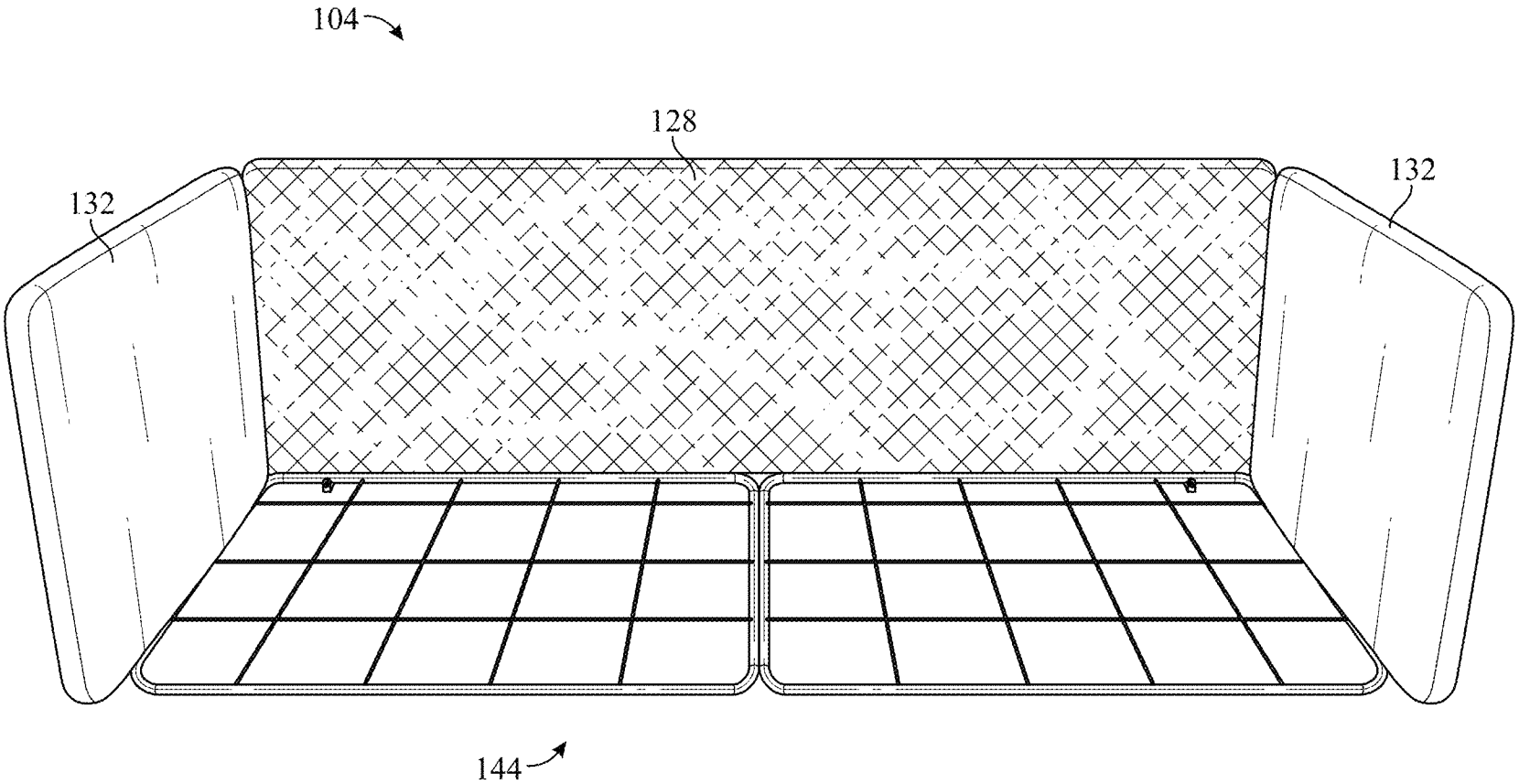
FIG. 20 is a perspective view of a portion of the frame of the convertible couch of FIG. 15.

Once the frame 104 is formed, the set of covers 120 is positioned over the back section 152 and the plurality of arms 148. In particular, the frame cover 128 is positioned over the back section 152 and the plurality of arm covers 132 is positioned over the plurality of arms 148, as illustrated in FIG. 20. The frame cover 128 and the plurality of arm covers 132 are slid onto the back section 152 and the plurality of arms 148, respectively. The frame cover 128 and the plurality of arm covers 132 may be slid onto the frame 104 without securement. However, in other examples, the frame cover 128 can be secured to the back section 152 and the plurality of arm covers 132 can be secured to the plurality of arms 148. Before or after the set of covers 120 are placed on the frame 104, a plurality of legs 160 may be placed along the frame 104 to lift the convertible couch 100 off the ground.

Figure 21:
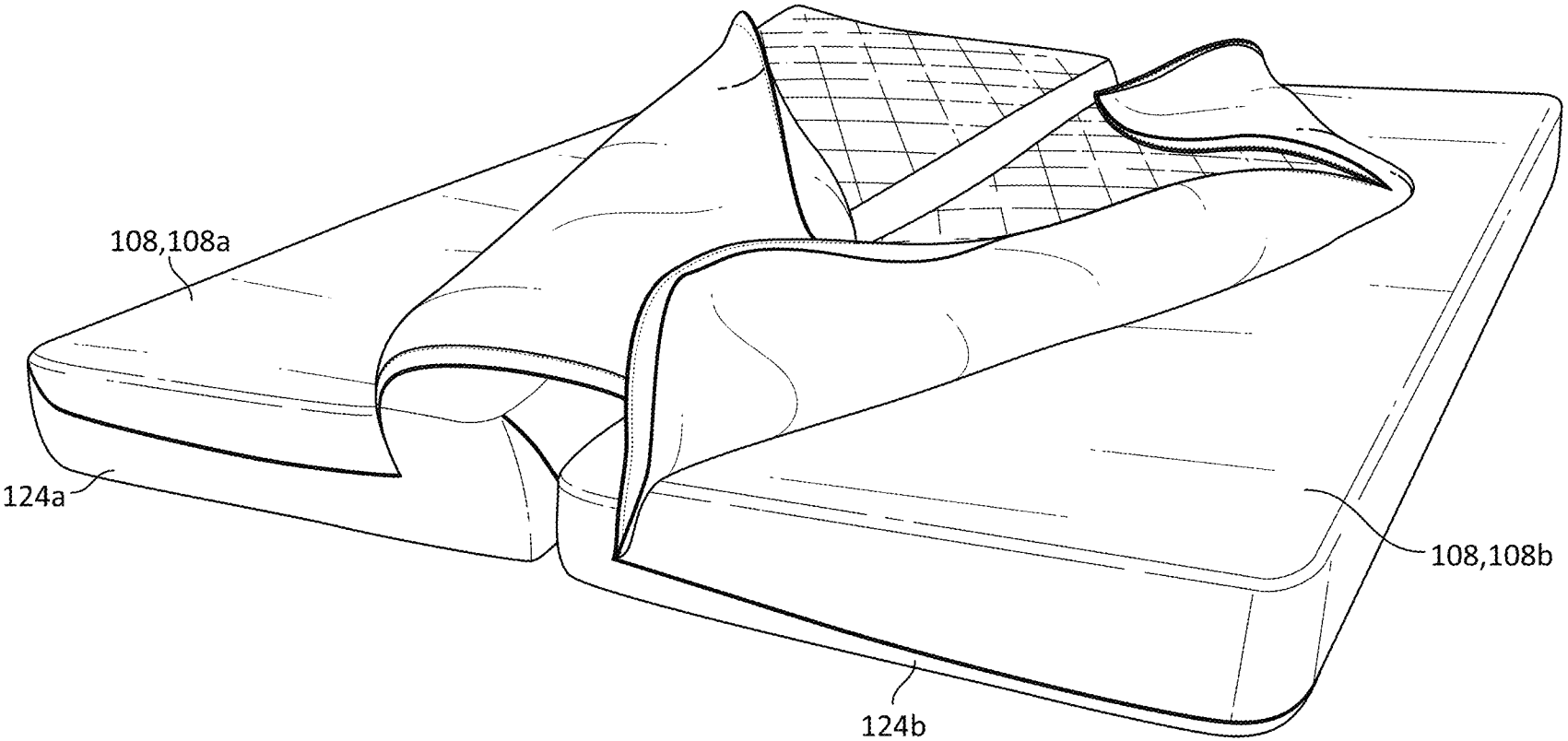
FIG. 21 is a perspective view of a seat cushion of the convertible couch of FIG. 13.
Figure 22:
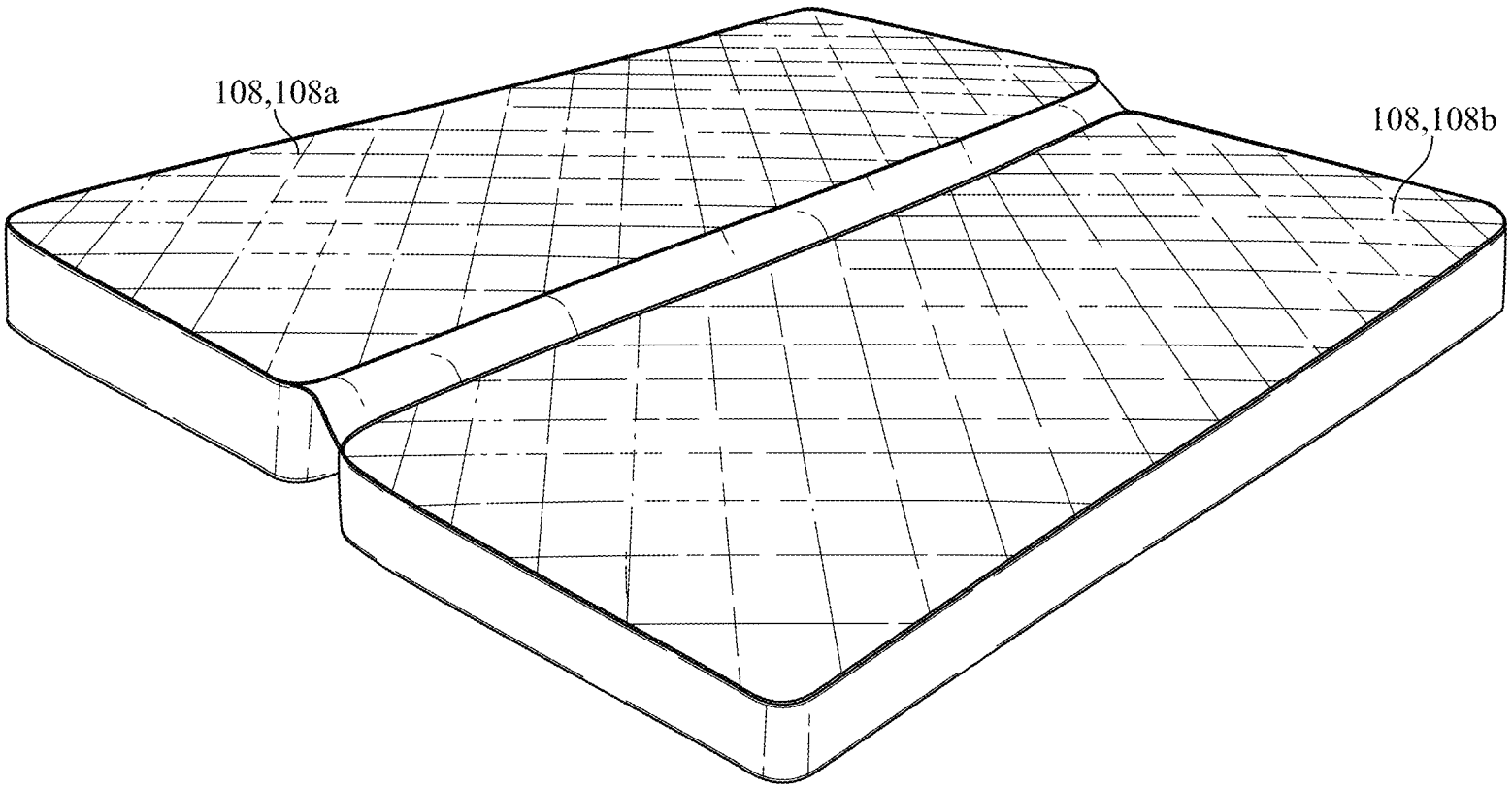
FIG. 22 is a perspective view of the seat cushion of FIG. 21 in a first configuration.
Figure 23:
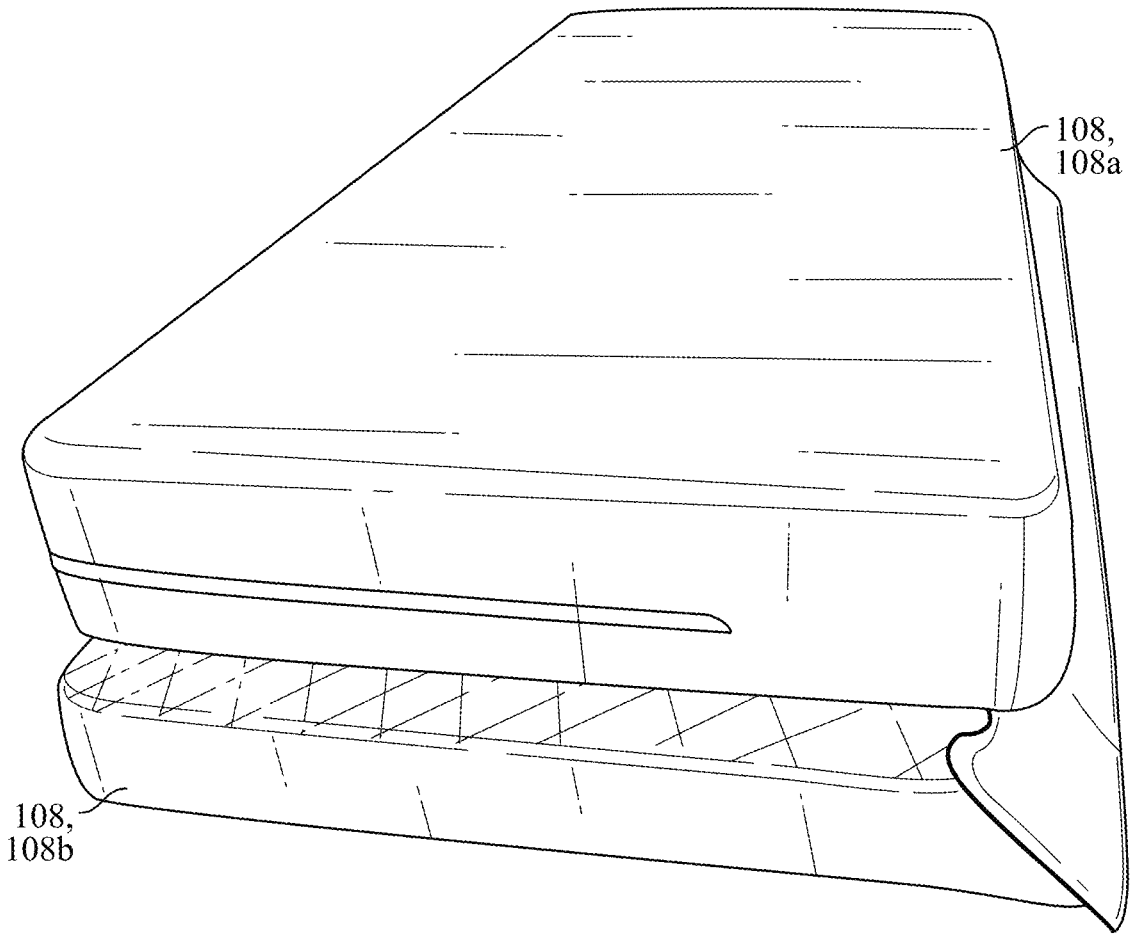
FIG. 23 is a perspective view of the seat cushion of FIG. 21 in a second configuration.

The method 300 also includes forming the seat cushion 108 (step 324). In particular, forming the seat cushion 108 includes placing the first portion 108*a* of the seat cushion 108 in the first pocket 124*a* of the seat cover 124. The second portion 108*b* of the seat cushion 108 in then placed in the second pocket 124*b* of the seat cover 124. FIG. 21 illustrates the first portion 108*a* of the seat cushion 108 placed in the first pocket 124*a* of the seat cover 124 and the second portion 108*b* of the seat cushion 108 placed in the second pocket 124*b* of the seat cover 124. Once properly inserted, the first pocket 124*a* and the second pocket 124*b* of the seat cover 124 are closed. The first and second pockets 124*a*, 124*b* of the seat cover 124 are closed by zipping a zipper disposed along the first and second pockets 124*a*, 124*b*, as illustrated in FIG. 22. In other examples, however, the first and second pockets 124*a*, 124*b* can be closed using hook-and-loop fasteners, a snap-fit, or other securement mechanism. FIGS. 22 and 23 illustrate the seat cushion 108 in the first configuration and the second configuration, respectively. As discussed above, the first and second pockets 124*a*, 124*b* are coupled to one another and function as a hinge. Accordingly, the first portion 108*a* of the seat cushion 108 rotates along an edge of the second portion 108*b* of the seat cushion 108 to transition between the first configuration and the second configuration.

Figure 24:
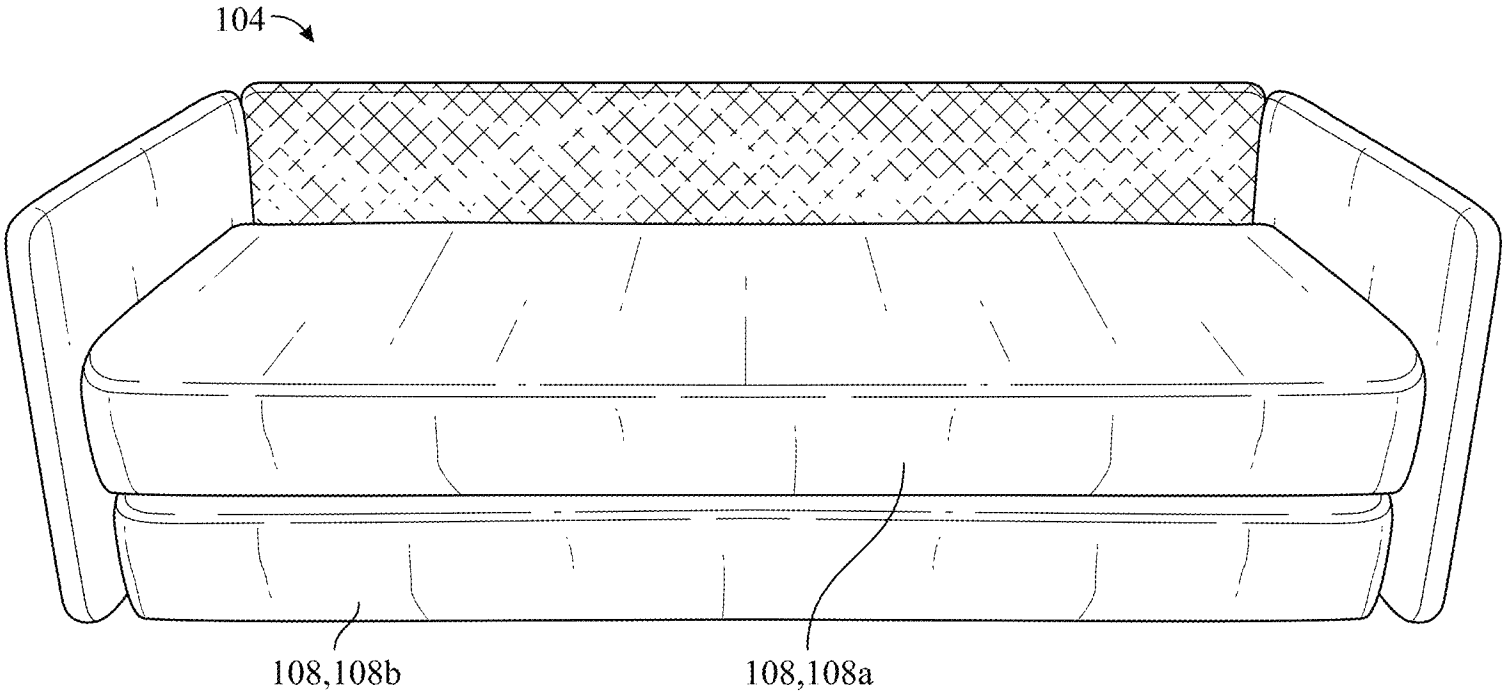
FIG. 24 is a perspective view of the convertible couch of FIG. 13 partially assembled.

With the seat cushion 108 placed within the seat cover 124 and the seat cushion 108 positioned in the first configuration, the seat cushion 108 is positioned on the seat section 144, between the back section 152 and the plurality of arms 148 (step 328). FIG. 24 illustrates the seat cushion 108 positioned within the frame 104.

Figure 25:
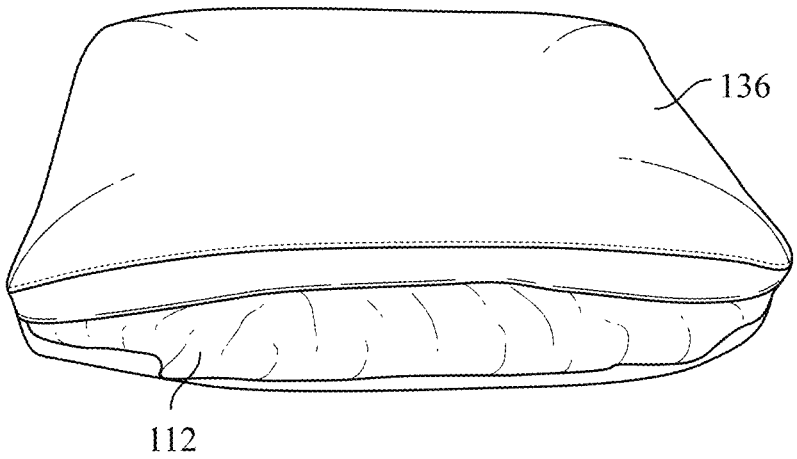
FIG. 25 is a perspective view of a rear cushion of the convertible couch of FIG. 13 in an unassembled configuration.
Figure 26:
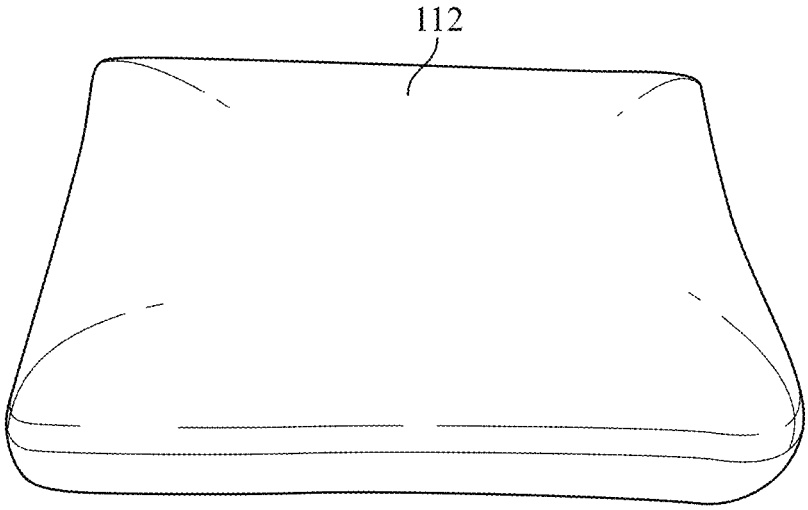
FIG. 26 is a perspective view of the rear cushion of the FIG. 24 in an assembled configuration.
Figure 27:
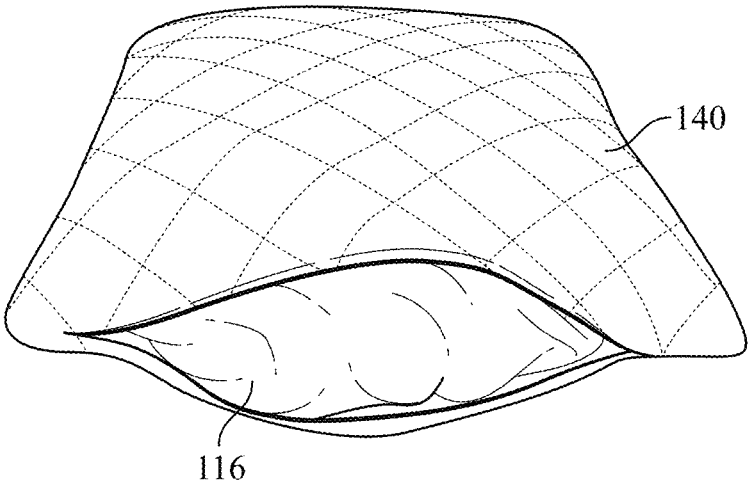
FIG. 27 is a perspective view of a side cushion of the convertible couch of FIG. 13 in an unassembled configuration.
Figure 28:
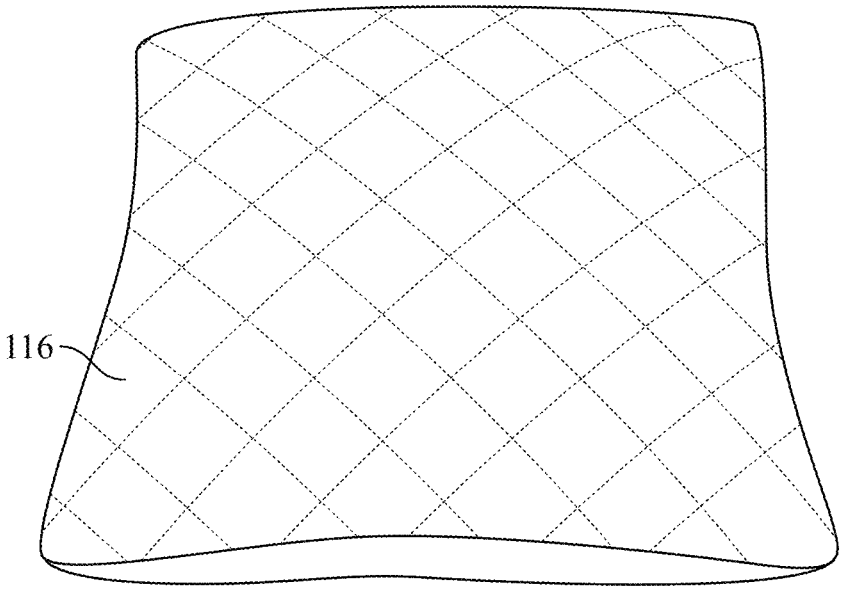
FIG. 28 is a perspective view of the side cushion of FIG. 26 in an assembled configuration.

As illustrated in FIG. 13, the convertible couch 100 includes the at least one back cushion 112 and the plurality of pillows 116. Each back cushion in the at least one back cushion 112 is disposed inside the back-cushion cover 136 and closed so that the back cushion is secured within the back-cushion cover 136. FIG. 25 illustrates a back cushion of the at least one back cushion 112 disposed inside the back-cushion cover 136, and FIG. 26 illustrates the back-cushion cover 136 closed. Each pillow in the plurality of pillows 116 is disposed inside the pillow cover 140 and closed so that the pillow is secured within the pillow cover 140. FIG. 27 illustrates a pillow of the plurality of pillows 16 disposed inside the pillow cover 140, and FIG. 28 illustrates the pillow cover closed 140. Once each back cushion in the at least one back cushion 112 is placed inside of the back-cushion cover 136, the back cushions are placed on the seat cushion 108 and against the back section 152 of the frame 104. Similarly, after each pillow in the plurality of pillows 116 is placed in the pillow cover 140, the pillows are placed on the seat cushion 108 and against the plurality of arms 148 of the frame 104.

Figure 29:
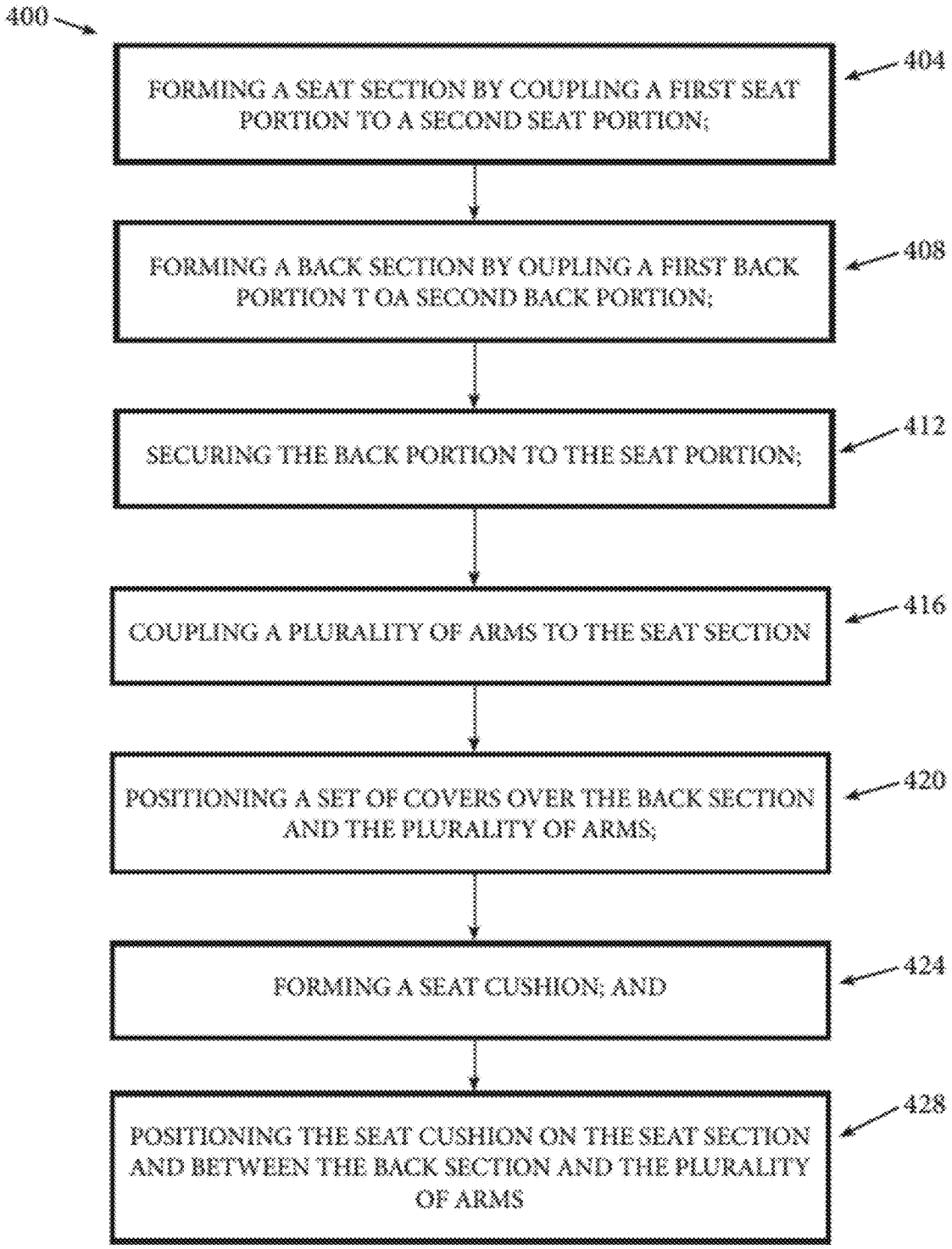
FIG. 29 is a flow chart depicting a method of packaging the convertible couch of FIG. 13 in a single box.

FIGS. 29-41 generally depict an example method of packaging a convertible couch 100 of FIG. 13 into a box 212. In particular, FIG. 29 depicts a flow chart of an example method of packaging the convertible couch 100 of FIG. 13 into the box 212, and FIGS. 30-41 depict the steps illustrated in FIG. 29. Accordingly, FIG. 29 and FIGS. 30-41 may be read in tandem to illustrate the method of packaging the convertible couch of FIG. 13 into the box 21.

Figure 30:
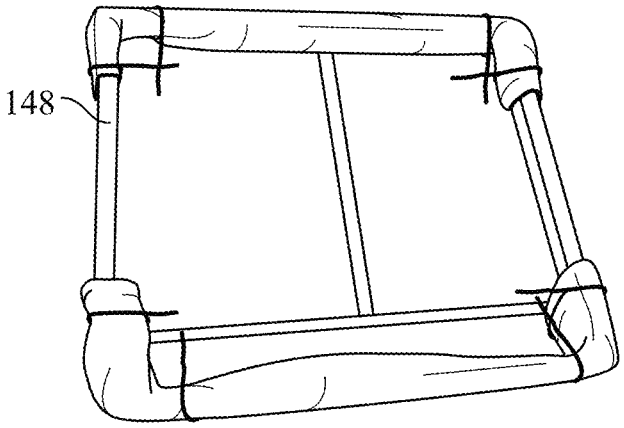
FIG. 30 is a perspective view of a partially assembled frame assembly.
Figure 31:
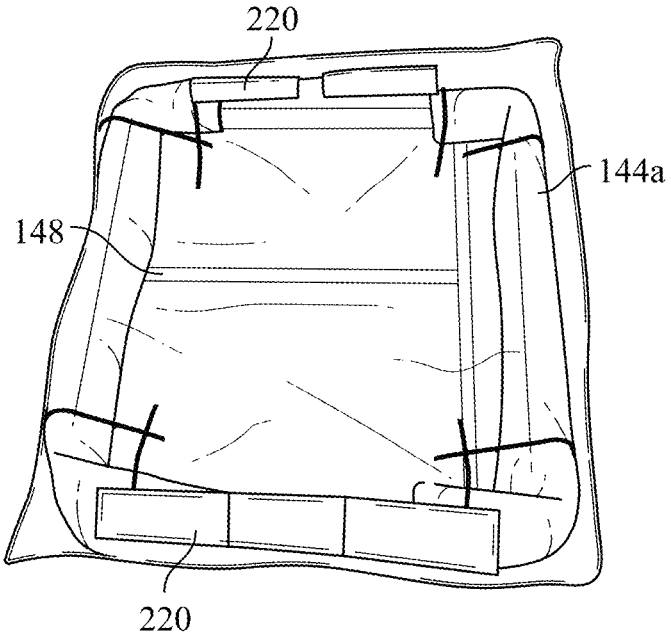
FIG. 31 is a perspective view of the partially assembled frame assembly of FIG. 30 including additional portions of the frame of FIG. 15.
Figure 32:
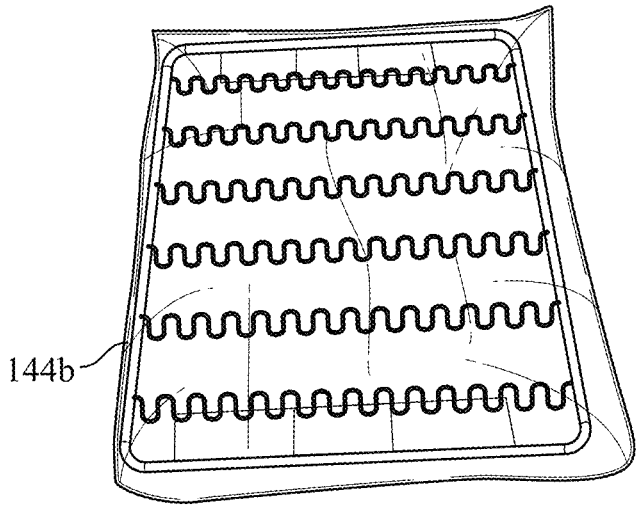
FIG. 32 is a perspective view of the partially assembled frame assembly of FIG. 31 including additional portions of the frame of FIG. 15.
Figure 33:
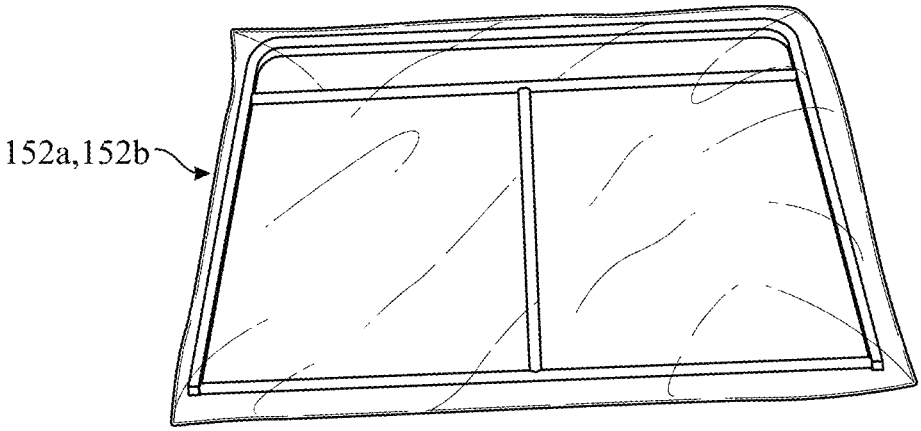
FIG. 33 is a perspective view of the partially assembled frame assembly of FIG. 32 including additional portions of the frame of FIG. 15.
Figure 34:
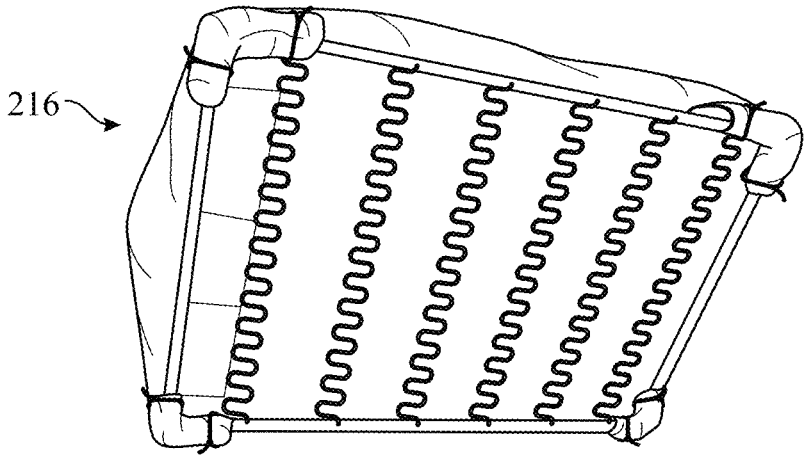
FIG. 34 is a perspective view of an assembled frame assembly.
Figure 35:
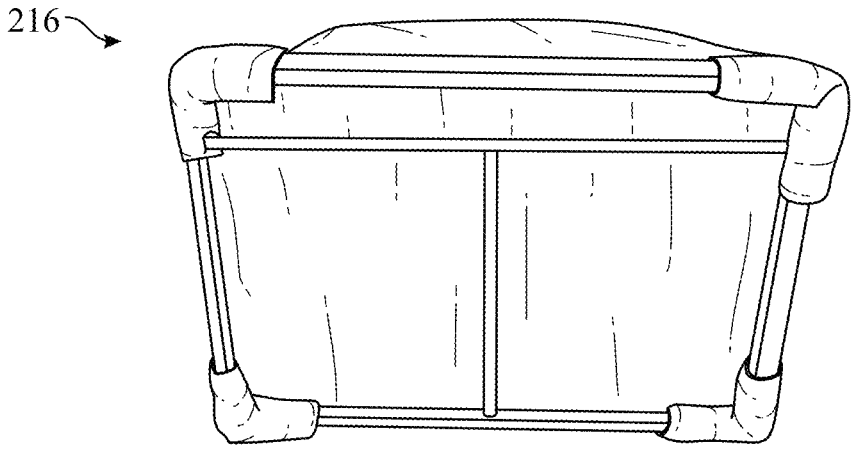
FIG. 35 is another perspective view of the assembled frame assembly of FIG. 34.

The method of packaging the convertible couch 100 (step 400) includes forming a frame assembly 216 (step 404). In particular, forming the frame assembly 216 includes coupling a plurality of arms 148 to one another. As illustrated in FIG. 30, the first arm 148*a* of the plurality of arms 148 is coupled to the second arm 148*b* of the plurality of arms 148 using zip-ties. However, other securement mechanisms may be used. Once the plurality of arms 148 are coupled to one another, a first seat portion 144*a* of the seat section 144 is coupled to a first side of the plurality of arms 148 such that a portion of the first seat portion 144*a* extends past the plurality of arms 148. As illustrated in FIG. 31, the hardware 220 is then disposed in the portion of the first seat portion 144*a* that extends past the plurality of arms 148. After securing the hardware, a second seat portion 144*b* of the seat section 144 is coupled to a second side of the plurality of arms 148 such that a portion of the second seat portion 144*b* of the seat section 144 extends past the plurality of arms 148. FIG. 32 illustrates the second seat portion 144*b* of the seat section 144 coupled to the second side of the plurality of arms 148. The first back portion 152*a* is coupled to the second back portion 152*b*. The coupled first and second back portions 152*a*, 152*b* are then coupled to the second seat portion 144*b*. FIG. 33 illustrates the coupled first and second back portions 152*a*, 152*b* disposed on the second seat portion 144*b*, while FIGS. 34 and 35 illustrates first and second sides of the assembled frame assembly 216. Additionally, the plurality of pillows 116 and the at least one back cushion 112 may be disposed within the frame assembly 216.

Figure 36:
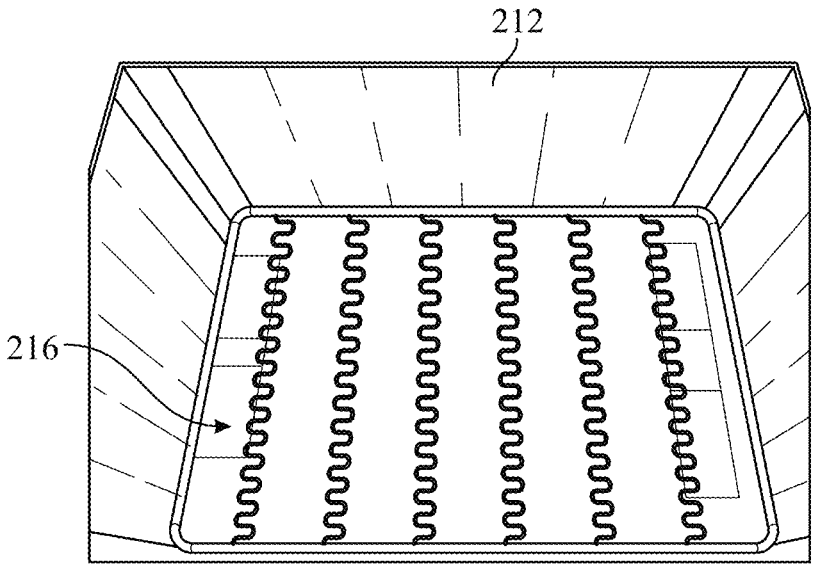
FIG. 36 is a perspective view of the assembled frame assembly of FIG. 34 placed in a box.
Figure 37:
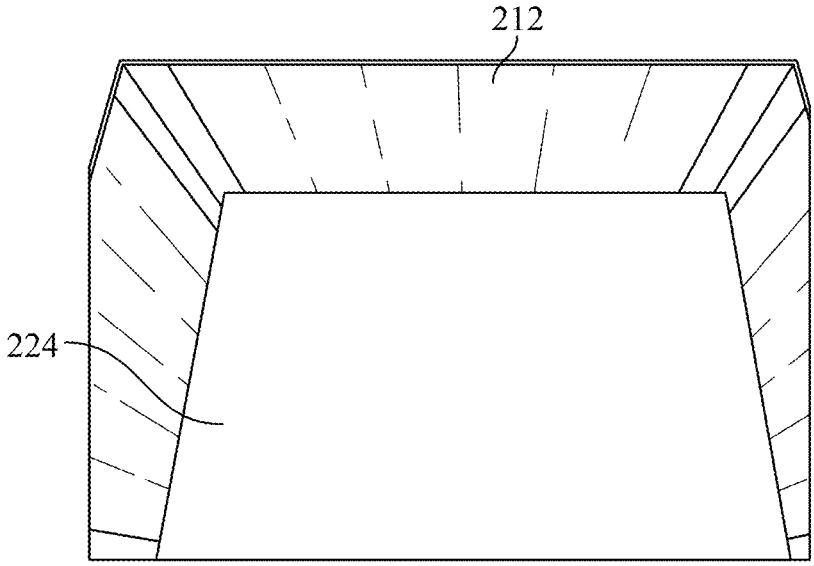
FIG. 37 is a perspective view of the box of FIG. 36 with a divider.
Figure 38:
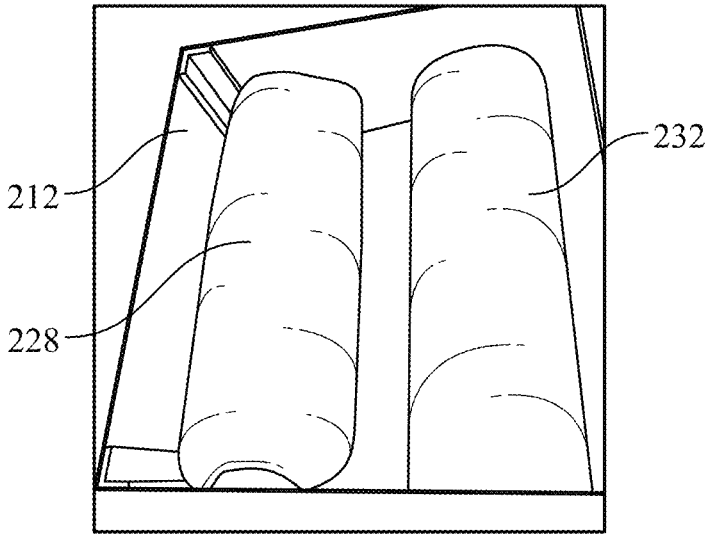
FIG. 38 is a perspective view of the box of FIG. 37 with a plurality of mattress rolls disposed on the divider in the box.

Once the frame assembly 216 is properly assembled, the frame assembly 216 is positioned within the box 212 (step 408), as illustrated in FIG. 36. A divider 224 is then disposed on top of the frame assembly 216. As illustrated in FIG. 37, the divider 224 is a piece of cardboard. In other examples, however, the divider 224 can be any material that mitigates, or prevents, any damage from occurring to the frame assembly 216 and provides a generally flat surface.

A first mattress roll 228 is formed (step 412) and a second mattress roll 232 is formed (step 416). Forming the first and second mattress rolls 228, 232 involves substantially similar steps and, for the sake of clarity, the process of forming only the first mattress roll 228 will be discussed. Forming the first mattress roll 228 involves tightly rolling a coil-spring mattress into a bundle. In some examples, before the coil-spring mattress is rolled into a bundle, at least one cover of the set of covers 120 can be placed on the coil-spring mattress. So configured, the at least one cover of the set of covers 120 will be disposed within the first mattress bundle 228. Once the coil-spring mattress is in a bundle, the coil spring mattress is secured using a stretch wrap, or any other securement mechanism. As mentioned above, the same process may be followed to form the second mattress roll 232. Once the first and second mattress rolls 228, 232 are formed, the first and second mattress rolls are positioned on the frame assembly 216 disposed in the box 212.

Figure 39:
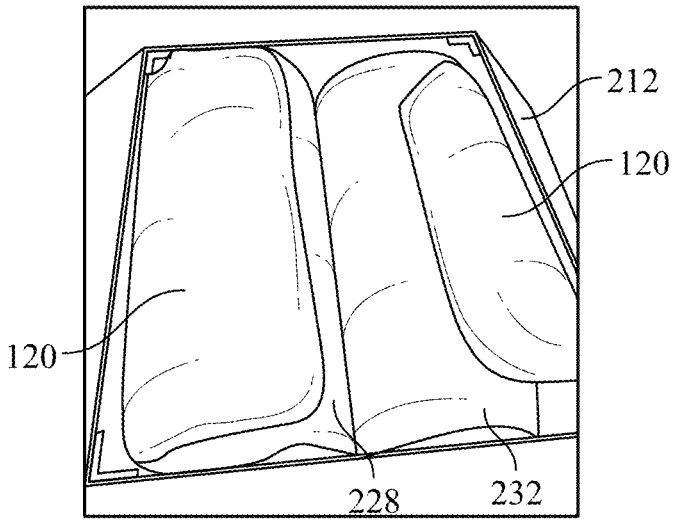
FIG. 39 is a perspective view of the box of FIG. 37 with a plurality of covers from a set of covers disposed in the box.
Figure 40:
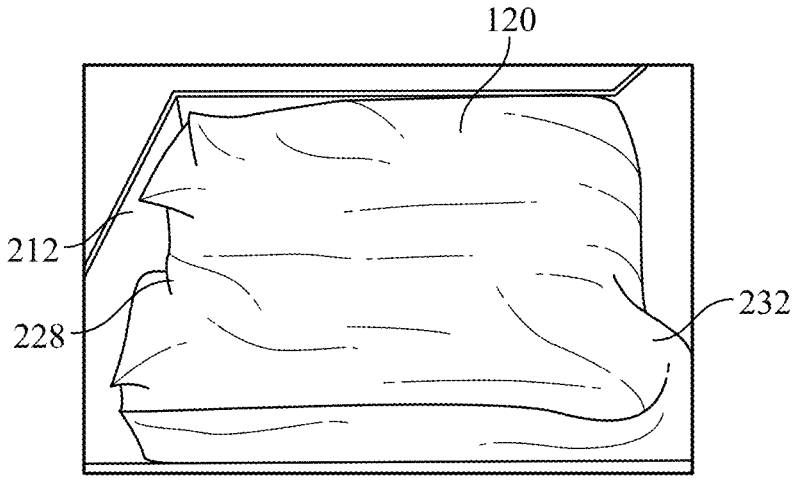
FIG. 40 is a perspective view of the box of FIG. 36 with a cover from the set of covers disposed in the box.
Figure 41:
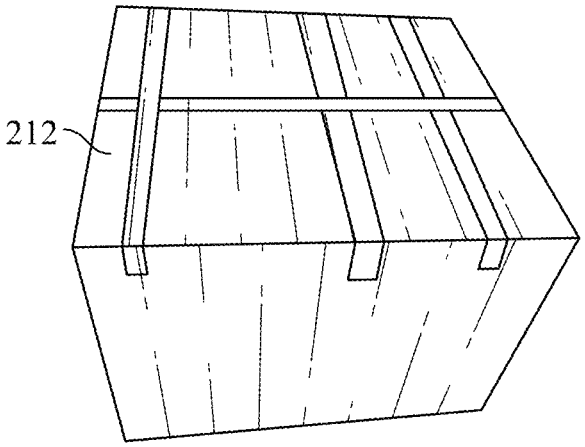
FIG. 41 is a perspective view of the box of FIG. 40 closed.

As mentioned above, the set of covers 120 may be placed into the first and second mattress rolls 228, 232. However, the set of covers 120, as illustrated in FIGS. 39 and 40, may be placed in at least one bag and then placed on top of the first and second mattress rolls 228, 232. In particular, as illustrated in FIG. 39, a portion of the set of covers 120 is positioned on a side of the first mattress roll 228 and another portion of the set of covers is positioned on a side of the second mattress roll 232. The remaining covers in the set of covers 120 are positioned on top of the first and second mattress rolls 228, 232, as illustrated in FIG. 40. With all the elements of the convertible couch 100 of FIG. 13 placed within the box 212, the box 212 is closed and sealed, as illustrated in FIG. 41.

While FIGS. 29-41 depict a method of packaging a convertible couch 100 of FIG. 13 into a single box 212, the convertible couch 100 may also be packaged into several parcels. Instead of a single box 212, smaller sized parcels may be used to ship the convertible couch 100 thereby minimizing shipping costs. For example, the convertible couch 100 may be separated and shipped in three parcels. In such an example, a first parcel includes the frame assembly 216, a second parcel includes the first and second rolled mattresses 228, 232, and a third parcel includes the at least one back cushion 112, the plurality of pillows 116, and the set of covers 120. The convertible couch 100 may also be separated and shipped in more or less parcels depending on the size of the convertible couch 100 and the amount of individual components of the convertible couch 100.

While several examples have been disclosed herein, any features from any examples may be combined with or replaced by other features from other examples. Moreover, while several examples have been disclosed herein, changes may be made to the disclosed examples without departing the from the scope of the claims.

What is claimed is:

1. A knock down (KD) sleeper-flip couch, comprising:

a frame, including:

a pair of arms;

a pair of back sections; and a pair of seat sections, each seat section including an outer side and an inner side including a rabbet having a shoulder and a cheek defining a pair of through holes; and a pair of seat fasteners, wherein, when the cheeks of the seat sections overlap, a lap joint is formed, the associated through holes of the seat sections align, and the seat fasteners are positioned through the through holes of the seat sections to couple the seat sections together.

2. The knock down (KD) sleeper-flip couch of claim 1, wherein each of the seat sections include a back side, each of the arm sections include a lower side and a back side, and each of the back sections include an inner side, an outer side, and a lower side, further comprising fasteners to: 1) couple the lower side of the arm sections to the corresponding outer sides of the seat sections; 2) couple the back sides of the arm sections to the corresponding outer sides of the back sections; 3) couple the inner sides of the back sections together; and 4) couple the lower sides of the back sections to the corresponding back side of the seat sections.

3. The knock down (KD) sleeper-flip couch of claim 1, wherein the seat sections comprise zig-zag springs.

4. The knock down (KD) sleeper-flip couch of claim 1, wherein the seat fasteners are thumb screws.

5. The knock down (KD) sleeper-flip couch of claim 4, wherein the thumb screws are central legs of the knock down (KD) sleeper-flip couch.

6. The knock down (KD) sleeper-flip couch of claim 1, further comprising a first seat cushion, a second seat cushion, a first seat cover, and a second seat cover, the first seat cover being coupled to the second seat cover by a living hinge, wherein the first seat cushion is positionable within the first seat cover and the second seat cushion is positionable within the second seat cover, the first seat cushion and the second seat cushion being stacked and in a first configuration to form a couch, the first seat cushion being rotated about the living hinge to position the first seat cushion and the second seat cushion in a second configuration to form a bed.

7. The knock down (KD) sleeper-flip couch of claim 6, wherein the bed is a king size bed.

8. The knock down (KD) sleeper-flip couch of claim 6, wherein the first seat cushion is a different thickness than the second seat cushion.

9. The knock down (KD) sleeper-flip couch of claim 6, wherein in the first configuration, the second seat cushion is positioned on the seat sections and the first seat cushion is positioned on top of the second seat section.

10. The knock down (KD) sleeper-flip couch of claim 9, wherein the first seat cushion has a greater thickness than the second seat cushion.

11. The knock down (KD) sleeper-flip couch of claim 1, further comprising arm covers and back section covers, the arm covers being positioned over the arm sections and the back section covers being positioned over the back sections.

12. The knock down (KD) sleeper-flip couch of claim 1, further comprising a pair of pillows and a pair of back cushions.

13. The knock down (KD) sleeper-flip couch of claim 12, further comprising a pair of pillow covers to cover the corresponding pillows and a pair of back cushion covers to cover the corresponding back cushions.

14. The knock down (KD) sleeper-flip couch of claim 1, wherein the first seat cushion and the second seat cushion comprise foam.

15. A knock down (KD) sleeper-flip couch kit, comprising:

a first container, including:

a frame, including:

a pair of arm sections;

a pair of back sections; and a pair of seat sections, each seat section including an outer side and an inner side including a rabbet having a shoulder and a cheek; wherein the arm sections are nested within corresponding seat sections;

a second container, including:

a first seat cushion and a second seat cushion; and a third container, including, a first seat cover and a second seat cover that are coupled together by a living hinge;

a pair of pillows;

a pair of back cushions;

a pair of pillow covers; and a pair of back cushion covers.

16. The knock down (KD) sleeper-flip couch kit of claim 15, wherein each of the first container, the second container, and the third container are less than 130 inches length and girth.

17. The knock down (KD) sleeper-flip couch kit of claim 15, wherein each of the first container, the second container, and the third container are approximately 125 inches length and girth.

* * * * *